US007261288B2

(12) United States Patent
Hosoya et al.

(10) Patent No.: US 7,261,288 B2
(45) Date of Patent: Aug. 28, 2007

(54) POSTPROCESSING APPARATUS WITH TWO OR MORE FINISHING DEVICES

(75) Inventors: Hisao Hosoya, Sagamihara-shi, Kanagawa-ken (JP); Kazuhiro Hirota, Hachioji-shi, Tokyo (JP); Kazuyoshi Omi, Kawagoe-shi, Saitama-ken (JP); Kazuaki Fukuda, Kawagoe-shi, Saitama-ken (JP); Yuji Kanazawa, Kiyose-shi, Tokyo (JP); Hideyo Ohashi, Miyoshi-cho, Iruma-gun, Saitama-ken (JP); Tomoki Nagaoka, Kodaira-shi, Tokyo (JP); Kohji Yoshie, Sagamihara-shi, Kanagawa-ken (JP); Hiroto Ito, Hachioji-shi, Tokyo (JP); Hitoshi Tamura, Hachioji-shi, Tokyo (JP); Masato Hattori, Hino-shi, Tokyo (JP); Teruhiko Toyoizumi, Tachikawa-shi, Tokyo (JP); Norishige Kato, Hachioji-shi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 10/246,192

(22) Filed: Sep. 18, 2002

(65) Prior Publication Data

US 2003/0062666 A1 Apr. 3, 2003

(30) Foreign Application Priority Data

Sep. 20, 2001 (JP) ..... 2001-286725

(51) Int. Cl.
*B65H 37/04* (2006.01)

(52) U.S. Cl. ..... 270/58.07; 270/32; 270/37; 270/45; 399/410; 399/407; 83/684; 83/669; 493/356

(58) Field of Classification Search ..... 270/58.07, 270/58.08, 58.12, 58.14, 58.16, 58.18, 32, 270/37, 45, 58.32, 58.31; 399/407, 410, 399/382; 493/352, 356, 372, 382, 351; 83/669, 83/684, 687
See application file for complete search history.

(56) References Cited

U.S. PATENT DOCUMENTS

| | | | | |
|---|---|---|---|---|
| 5,108,082 | A | 4/1992 | Shea et al. | |
| 5,112,034 | A * | 5/1992 | Uto et al. | 270/58.12 |
| 5,449,157 | A * | 9/1995 | Kawano et al. | 270/58.11 |
| 5,628,502 | A * | 5/1997 | Amarakoon | 270/58.07 |
| 5,709,376 | A * | 1/1998 | Ushirogata | 270/58.11 |
| 5,762,329 | A * | 6/1998 | Nakazato et al. | 270/58.09 |
| 5,966,579 | A * | 10/1999 | Asai et al. | 399/407 |
| 6,027,107 | A * | 2/2000 | Natsume et al. | 270/37 |
| 6,042,098 | A * | 3/2000 | Kubota et al. | 270/58.02 |
| 6,102,385 | A * | 8/2000 | Wakamatsu et al. | 270/58.12 |
| 6,120,015 | A * | 9/2000 | Albright et al. | 270/58.07 |
| 6,330,422 | B1 * | 12/2001 | Sato et al. | 399/382 |

(Continued)

FOREIGN PATENT DOCUMENTS

JP 59223646 A * 12/1984

(Continued)

*Primary Examiner*—Patrick Mackey
(74) *Attorney, Agent, or Firm*—Lucas & Mercanti, LLP

(57) ABSTRACT

A postprocessing apparatus stops and positions an image recording sheet delivered from an image forming apparatus at a predetermined position, punches the sheet with a punching unit, and thereafter folds the sheet with a folding unit.

20 Claims, 20 Drawing Sheets

U.S. PATENT DOCUMENTS

| | | | | |
|---|---|---|---|---|
| 6,381,443 | B1 * | 4/2002 | Kawata et al. | 399/407 |
| 2002/0117793 | A1 * | 8/2002 | Hosoya et al. | 270/4 |

FOREIGN PATENT DOCUMENTS

| | | | | |
|---|---|---|---|---|
| JP | 4064577 | | | 2/1992 |
| JP | 6072064 | | | 3/1994 |
| JP | 6182697 | | | 7/1994 |
| JP | 6268973 | | | 9/1994 |
| JP | 7048062 | | | 2/1995 |
| JP | 7187479 | | | 7/1995 |
| JP | 8192951 | | | 7/1996 |
| JP | 8319054 | | | 12/1996 |
| JP | 10148983 | | | 6/1998 |
| JP | 10167562 | | | 6/1998 |
| JP | 11348451 | | | 12/1999 |
| JP | 2000128419 | A | * | 5/2000 |
| JP | 2000169029 | A | * | 6/2000 |
| JP | 2000177922 | A | * | 6/2000 |
| JP | 2000-219420 | | | 8/2000 |
| JP | 2001-026338 | | | 1/2001 |
| JP | 2001-026370 | | | 1/2001 |
| JP | 2001026338 | A | * | 1/2001 |
| JP | 2001-146363 | | | 5/2001 |
| JP | 2001-206626 | | | 7/2001 |
| JP | 2001316035 | A | * | 11/2001 |
| JP | 2002060127 | A | * | 2/2002 |
| JP | 2002179331 | A | * | 6/2002 |
| JP | 2002308521 | A | * | 10/2002 |

* cited by examiner

POSTPROCESSING APPARATUS WITH TWO OR MORE FINISHING DEVICES

BACKGROUND OF THE INVENTION

1. Field of the Invention

The present invention relates to a postprocessing apparatus (also called a finisher) which subjects a sheet where an image is formed by an image forming apparatus such as a copying machine, a printer, a facsimile apparatus, or a composite machine of them, to a punching process, a two-fold process, a Z-fold process, a stitching process, and the like, and an image forming system which has this postprocessing apparatus.

2. Description of Related Art

In recent years, there have been provided a postprocessing apparatus which subjects a sheet where an image is formed by an image forming apparatus such as a copying machine, a facsimile apparatus, or a composite machine of them, to a punching process, a two-fold process, and a Z-fold process, to enable file stitching, and an image forming system which is obtained by adding an image forming apparatus to this postprocessing apparatus.

A postprocessing apparatus which subjects a bundle of sheets, that form one set with a plurality of sheets, to a saddle stitching process is disclosed in Japanese Unexamined Patent Publication Nos. 6-72064, 7-187479, 8-192951, and the like.

A postprocessing apparatus which enables center folding is proposed in Japanese Unexamined Patent Publication Nos. 7-48062, 10-148983, 10-167562, and 11-348451, U.S. Pat. No. 5,108,082, and the like.

A processing apparatus which subjects a sheet to a folding process is popular in the field of bookbinding. A processing apparatus which folds one or a comparatively small number of sheets is popular as an apparatus for forming a sealed document such as a postal matter.

A punching apparatus described in Japanese Unexamined Patent Publication No. 6-182697 is provided midway along the sheet convey path of a sorter that sorts sheets delivered from an image forming apparatus.

A bookbinding apparatus described in Japanese Unexamined Patent Publication No. 8-319054 has a punching means for forming string binding holes in a sheet by a punching process. The punching means is provided midway along the sheet convey path of the bookbinding apparatus which binds a plurality of sheets, delivered from the delivery portion of a copying machine, in a stacked state.

A folding apparatus for subjecting a sheet to a folding process such as a Z-fold process or the like is disclosed in Japanese Unexamined Utility Model Publication No. 62-68973, Japanese Unexamined Patent Publication No. 4-64577, and the like.

A sheet postprocessing apparatus which enables folding in two is disclosed in Japanese Unexamined Patent Publication Nos. 10-148983 and 10-167562.

Any conventional folding apparatus is a large, expensive one which aims at processing a large number of sheets at a high speed.

In addition to a large number of uniform documents, many documents need to be handled differently in a comparatively small unit. Among documents to be sealed such as direct mail, documents which bear different information such as addresses, e.g., slips, need folding. In this case, the different documents must be manually sorted before or after they are subjected to a folding apparatus.

In this manner, the conventional apparatus which uniformly processes a large number of documents cannot improve the overall efficiency.

The conventional postprocessing apparatus has a center folding portion and three-fold portion that are separate from each other, to complicate the structure that forms different sheet convey paths. Particularly in a structure in which the different sheet convey paths are bent, jamming tends to occur easily.

Furthermore, in the conventional postprocessing apparatus which performs punching, folding into a Z shape, and folding in two, punching is performed after an image recording sheet delivered from an image forming apparatus is folded. The fold of a folded sheet is not always parallel to the leading end or trailing end of the sheet in the convey direction, but is sometimes skew from it. If the skew sheet is punched with reference to its fold for abutment, holes are not formed at predetermined positions of the sheet. When sheets each punched in this manner are filed, a plurality of sheets become unaligned.

SUMMARY OF THE INVENTION

The present invention has been made to solve the above problems of the conventional related technique, and has as its object to provide a compact, multi-functional postprocessing apparatus which can cope with a variety of purposes flexibly so that it can form a folded document at a high efficiency as a whole, and an image forming apparatus having a sheet postprocessing apparatus.

It is another object of the present invention to provide a postprocessing apparatus which forms, by a punching process, a hole at a predetermined position of a sheet correctly, and an image forming system comprised of the postprocessing apparatus and an image forming apparatus.

(1) In order to achieve the above objects, according to a first aspect of the present invention, there is provided a postprocessing apparatus comprising: punching means for forming, by a punching process, a hole for sheet filing at a predetermined position of one sheet conveyed by sheet convey means; stitching means, arranged downstream of the punching means in a sheet convey direction, and capable of performing two stitching processes including an end stitching process of stitching a sheet at the vicinity of a side end thereof and a saddle stitching process of stitching a sheet at a center thereof in the convey direction; folding means, arranged downstream of the stitching means in the sheet convey direction, and capable of performing a two-fold process of folding the sheet at a center thereof in the convey direction and a three-fold process of forming two folds on the sheet to be parallel to the convey direction; and control means for selectively controlling the punching process, the end stitching process, the saddle stitching process, the two-fold process, and the three-fold process in accordance with a selection signal that selects either one of the processes.

(2) In order to achieve the above objects, according to a second aspect of the present invention, there is provided a postprocessing apparatus comprising stitching means which is capable of performing two stitching processes including an end stitching process of stitching a sheet conveyed by sheet convey means at the vicinity of a side end thereof and a saddle stitching process of stitching a sheet at a center thereof in a convey direction, and folding means, arranged downstream of the stitching means in the sheet convey direction, and capable of performing a two-fold process of folding the sheet at the center thereof in the convey direction and a three-fold process of forming two folds on the sheet to be parallel to the convey direction, wherein a sheet bundle forming portion formed of the stitching means and the folding means is mounted on one flat plate-like frame, the stitching means, the folding means, and the frame are formed into one unit, and the unit is mounted on a postprocessing apparatus main body to be withdrawable therefrom.

(3) In order to achieve the above objects, according to a third aspect of the present invention, there is provided a postprocessing apparatus comprising: punching means for forming, by a punching process, a hole for sheet filing at a predetermined position of one sheet conveyed by sheet convey means; two-stage feeding means, arranged on an upper portion of a postprocessing apparatus main body, and capable of feeding two types of sheets to an upstream side of the punching means; stitching means, arranged downstream of the punching means in a sheet convey direction, and capable of performing two stitching processes including an end stitching process of stitching a sheet at the vicinity of a side end thereof and a saddle stitching process of stitching a sheet at a center thereof in the convey direction; folding means, arranged downstream of the stitching means in the sheet convey direction, and capable of performing a two-fold process of folding the sheet at the center thereof in the convey direction and a three-fold process of forming two folds on the sheet to be parallel to the convey direction; shift means, arranged downstream of the punching means in the sheet convey direction, for shifting the sheet in a direction perpendicular to the convey direction; sheet branching means, arranged downstream of the punching means in the sheet convey direction, for selecting either one of a sheet bundle forming portion formed of the stitching means and the folding means, and the shift means, so a sheet that has passed through the punching means can be conveyed, and control means for selectively controlling a sheet feeding process, the punching process, the stitching process, the folding processes, a shift process, and a branching process in accordance with a selection signal that selects either one of the processes.

(4) In order to achieve the above objects, according to a fourth aspect of the present invention, there is provided a postprocessing apparatus which stops and positions an image recording sheet, delivered from an image forming apparatus, at a predetermined position, punches the sheet with punching means, and folds the sheet with folding means.

(5) In order to achieve the above objects, according to a fifth aspect of the present invention, there is provided a postprocessing apparatus comprising: a first postprocessing apparatus formed of first punching means for performing a punching process at a predetermined position of an image recording sheet delivered from an image forming apparatus, and first folding means for folding the punched sheet; and a second postprocessing apparatus formed of delivery means for introducing and delivering the sheet punched and folded by the first postprocessing apparatus, feeding means for storing and feeding a sheet other than the image recording sheet, and second punching means for performing a punching process at a predetermined position of the sheet fed from the feeding means.

(6) In order to achieve the above objects, according to a sixth aspect of the present invention, there is provided an image forming system comprising an image forming apparatus formed of image writing means, image forming means, and sheet convey means, and the postprocessing apparatus according to any one of above items (1) to (5).

According to the first aspect of item (1), the punching means, stitching means, folding means, and sheet convey path are simply arranged and downsized. Therefore, an image forming apparatus comprising a postprocessing apparatus having these means can be made compact while having a function of folding in two and a function of folding in three.

According to the second aspect of item (2), the stitching means, folding means, and sheet convey path are arranged on a flat plate-like frame which is arranged with a steep inclination, thus forming a detachable unit. Therefore, troubleshooting of sheet convey, inspection of a trouble, maintenance, and the like in the stitching means and folding means can be performed easily.

According to the third aspect of item (3), the two-stage feeding means, punching means, stitching means, folding means, shift means, delivery means, and branching means are arranged in the postprocessing apparatus efficiently. Therefore, the postprocess can be performed at a high speed with a compact arrangement.

According to the fourth aspect of item (4), a sheet, the leading end of which is aligned, is conveyed as it is clamped by registration rollers, and after that it is punched before being folded. Therefore, the punching position precision can be improved regardless of the folding state or folding precision.

According to the fifth aspect of item (3), a desired digital process is performed by using an image forming apparatus such as a copying machine, a printer, a facsimile apparatus, or a composite machine of them. After image formation, the delivered sheet is punched and folded into a Z shape quickly and accurately by the print-on-demand (POD) type postprocessing apparatus of the present invention.

According to the sixth aspect of item (6), the postprocessing apparatus connected to the image forming apparatus such as a copying machine, a printer, or the like performs a desired digital process with an image forming apparatus main body. Processes such as single-side printing, double-side printing, page compilation, and the like are performed. A sheet delivered after fixing is subjected to processes such as sheet convey, punching, shifting, end stitching, side stitching, saddle stitching, center folding, folding in three, and the like correctly and efficiently at a high speed by the postprocessing apparatus of the present invention. The sheet which is processed at a high speed by the image forming apparatus main body and delivered is postprocessed by the postprocessing apparatus of the present invention at a high speed with a high productivity.

The above and many other objects, features and advantages of the present invention will become manifest to those skilled in the art upon making reference to the following detailed description and accompanying drawings in which preferred embodiments incorporating the principle of the present invention are shown by way of illustrative examples.

DETAILED DESCRIPTION OF THE PREFERRED EMBODIMENTS

A postprocessing apparatus according to the present invention, and an image forming system having the postprocessing apparatus will be described with reference to the accompanying drawings.

Figure 1:
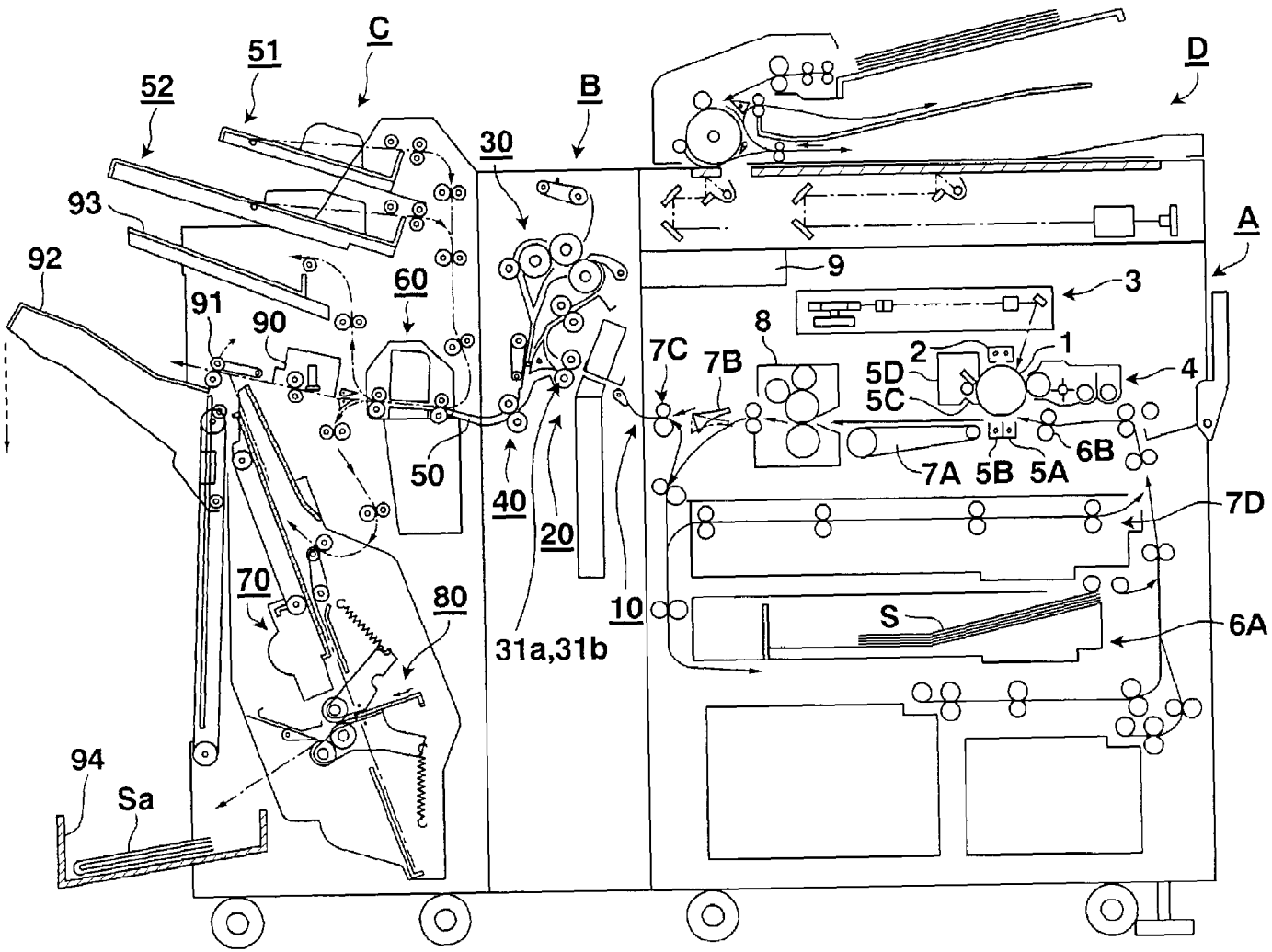
FIG. 1 is a view showing the overall arrangement of an image forming system comprised of an image forming apparatus, first postprocessing apparatus, second postprocessing apparatus, and image reading apparatus.

(1) Image Forming System:

The image forming system according to the present invention is comprised of an image forming apparatus A, first postprocessing apparatus B, second postprocessing apparatus C, and image reading apparatus D, as shown in FIG. 1.

The image reading apparatus D having an automatic document feeder which reads an original while moving it is set on the upper portion of the image forming apparatus A.

A sheet S loaded in the first postprocessing apparatus B is processed in accordance with at least selected one of punching, folding into a Z shape, and the like, and is supplied into the second postprocessing apparatus C.

The first postprocessing apparatus B is comprised of an inlet 10, first punching means 20, first holding means 30, and delivery means 40.

The sheet S punched and folded by the first postprocessing apparatus B, or the sheet S which is delivered from the image forming apparatus A and passes through the first postprocessing apparatus B without being subjected to these postprocesses, is delivered from the delivery means 40 and loaded through an inlet 50 of the second postprocessing apparatus C adjacent to the first postprocessing apparatus B.

A first feeder 51, second feeder 52, second punching means 60, stitching means 70, second folding means 80, shift means 90, delivery means 91, vertically movable delivery table 92, upper delivery table 93, lower delivery table 94, and the like are arranged in the second postprocessing apparatus C.

Figure 2A:
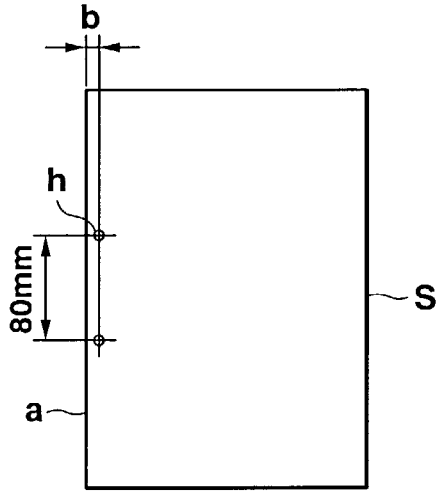
FIGS. 2A to 2C are plan views showing different types of sheets punched by first or second punching means.
Figure 2B:
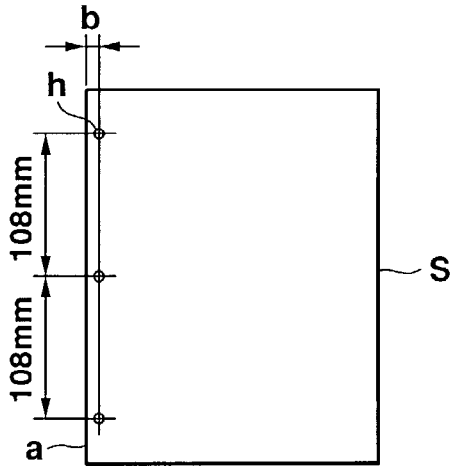
Figure 2C:
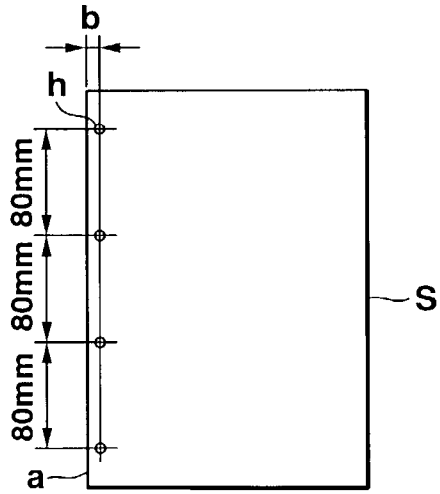

FIGS. 2A to 2C are plan views showing different types of sheets punched by first or second punching means 20 or 60. FIG. 2A shows an example in which holes h are formed at two portions in the vicinity of an end side a of the sheet S (two-hole file). FIG. 2B shows an example in which holes h are formed at three portions (three-hole file). FIG. 2C shows an example in which holes h are formed at four portions (four-hole file).

The interval of the plurality of holes h is standardized. A punched end face distance b from the end side a of the sheet S to the holes h can be arbitrarily set and is generally 9 mm to 11 mm.

Figure 3A:
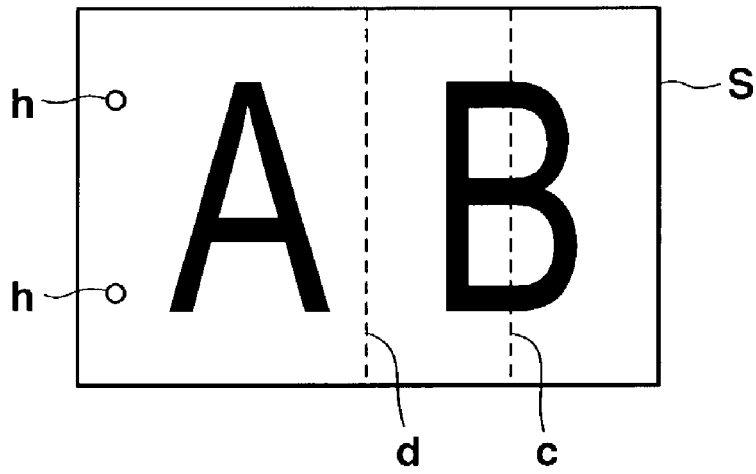
FIG. 3A is a plan view of a punched sheet before it is folded into a Z shape.

FIG. 3A is a plan view of a punched sheet before it is folded into a Z shape, in which broken lines c and d respectively indicate the first and second folds, and reference symbols h denote holes formed by punching.

Figure 3B:
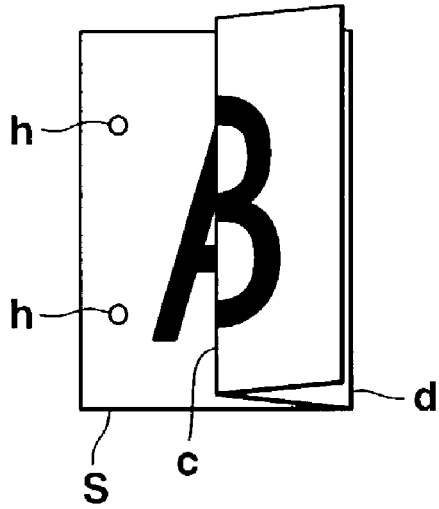
FIG. 3B is a perspective view of the sheet which is folded into a Z shape.

FIG. 3B is a perspective view of a sheet which is folded into a Z shape. The sheet S folded into a Z shape by the first postprocessing apparatus B is folded to form the first and second folds c and d.

The image forming apparatus A, first postprocessing apparatus B, and second postprocessing apparatus C which form the image forming system according to the present invention will be sequentially described in detail. As the image reading apparatus D, a conventional one is used, and a detailed description thereof will accordingly be omitted.

(2) Image Forming Apparatus A:

As shown in FIG. 1, in the image forming apparatus A, a charging means 2, image exposing means (write means) 3, developing means 4, transfer means 5A, discharging means 5B, separating pawl 5C, and cleaning means 5D are arranged around a rotatable image carrier (photosensitive body) 1 to form an image forming portion. The surface of the image carrier 1 is uniformly charged by the charging means 2. After that, the surface of the image carrier 1 is exposed and scanned by a laser beam from the image exposing means 3 on the basis of image data read from the original, thus forming a latent image. The latent image is converted and developed by the developing means 4, thus forming a toner image on the surface of the image carrier 1.

An image recording sheet (to be referred to as sheet hereinafter) S fed from a feeding means 6A is sent to a transfer position through an intermediate feeder 6B. At the transfer position, the toner image is transferred onto the sheet S by the transfer means 5A. After that, charges on the lower surface of the sheet S are erased by the discharging means 5B. The sheet S is separated from the image carrier 1 by the separating pawl 5C, is conveyed by a convey means 7A, is successively heated and fixed by a fixing means 8, and is delivered by a delivery means 7C.

When forming images on the two surfaces of the sheet S, the sheet S heated and fixed by the fixing means 8 is branched from the ordinary delivery path by a convey path switching plate 7B, is switched back and converted upside down by a converting convey means 7D, and is delivered outside the apparatus by the delivery means 7C. The sheet S delivered from the delivery means 7C is sent to the inlet 10 of the first postprocessing apparatus B.

A developing agent remaining on the surface of the image carrier 1 after image processing is removed by the cleaning means 5D downstream of the separating pawl 5C, so the image carrier 1 prepares for the next image formation.

An operating portion 9 where an image formation mode and sheet postprocessing mode are selectively set is arranged on the front surface of the upper portion of the image forming apparatus A.

(3) First Postprocessing Apparatus B:

The arrangement and operation of the first postprocessing apparatus B will be described with reference to FIG. 4.

The sheet S delivered from the delivery means 7C of the image forming apparatus A is introduced to the inlet 10 of the first postprocessing apparatus B. At the inlet 10 that forms a sheet entering portion, an inlet guide plate 11 biased in one direction by a spring 12 is swingably supported by the apparatus main body.

A sensor PS1 for detecting that the leading or trailing end of the sheet S has passed through it is arranged downstream of the inlet 10 in the sheet convey direction. The first punching means 20 is arranged further downstream of the sensor PS1.

A pair of registration rollers 31A and 31B are provided downstream of the first punching means 20 in the sheet convey direction. A pair of intermediate convey rollers 33A and 33B and a switching means 34 for switching the convey direction are provided to a first convey path ① formed of a pair of guide plates 32. The switching means 34 is swung by a solenoid SD1.

A pair of first folding rollers 35A and 35B which press against each other, and a second folding roller 35C pressed against by one first folding roller 35B are provided downstream of the first convey path ①. The surfaces of the first folding rollers 35A and 35B and second folding roller 35C are made of a material with a high frictional resistance, e.g., rubber.

A pair of guide plates 36 provided on the two sides of the sheet S in the direction of thickness form a second convey path ② on an extension of the first convey path ①. A first stopping means 37 is arranged in the vicinity of the second convey path ② on the downstream in the convey direction.

The first stopping means 37 has a pivotal endless belt 37C wound around a driving pulley 37A and driven pulley 37B, and an abutting portion 37D fixed to one portion of the endless belt 37C and projectable toward the outer surface of the endless belt 37C.

The abutting portion 37D is driven together with the endless belt 37C by a stepping motor M1, and is moved to a selected position among a plurality of predetermined positions in accordance with the size of the sheet S to be processed in the sheet convey direction. After that, the abutting portion 37D is stopped.

The abutting portion 37D is provided at two portions in the sheet widthwise direction perpendicular to the sheet convey direction. Hence, the abutting portions 37D hold the leading end of the sheet S to be perpendicular to the traveling direction, and the sheet S accurately abuts against the abutting portions 37D.

The first folding rollers 35A and 35B, guide plates 36, first stopping means 37, and stepping motor M1 form the first sheet folding portion.

The sheet S which has passed through the first convey path ① and entered the second convey path ② is continuously conveyed by the intermediate convey rollers 33A and 33B even after its leading end is abutted against by the abutting portion 37D. Hence, the sheet S slacks. The slacking portion of the sheet S is caught between the first folding rollers 35A and 35B, so it forms a first fold c.

Furthermore, guide plates 38 provided on the two sides of the direction of thickness of the sheet S form a third convey path ③ downstream of the first folding rollers 35A and 35B in the convey direction.

Similarly to the first stopping means 37, a second stopping means 39, against which the first fold c of the sheet S as the leading end abuts, thus stopping the sheet S, is provided to the third convey path ③ to be movable in the sheet convey direction. The second stopping means 39 is formed of a driving pulley 39A, driven pulley 39B, endless belt 39C, abutting portion 39D, and stepping motor M2.

The sheet S, which is folded by the first folding rollers 35A and 35B and conveyed, abuts against the abutting portion 39D of the second stopping means 39 with its first fold c as the leading end, and is flexed again, so it is caught between one first folding roller 35B and the second folding roller 35C, thus forming a second fold d.

A pair of guide plates 351 are provided downstream of the clamping position of the second folding roller 35C and a driven roller 35D. The guide plates 351 form a fourth convey path ④ which serves to deliver the folded sheet S. The fourth convey path ④ merges with the third convey path ③ on its downstream side, and continues to the second stopping means 39 and then to the delivery means 40. The delivery means 40 is formed of a delivery path 41 and a pair of delivery rollers 42A and 42B.

The processing operation of the first postprocessing apparatus B with the above arrangement, that is, the processes of simple sheet passing, punching, folding in two, and folding into a Z shape will be described.

Figure 4:
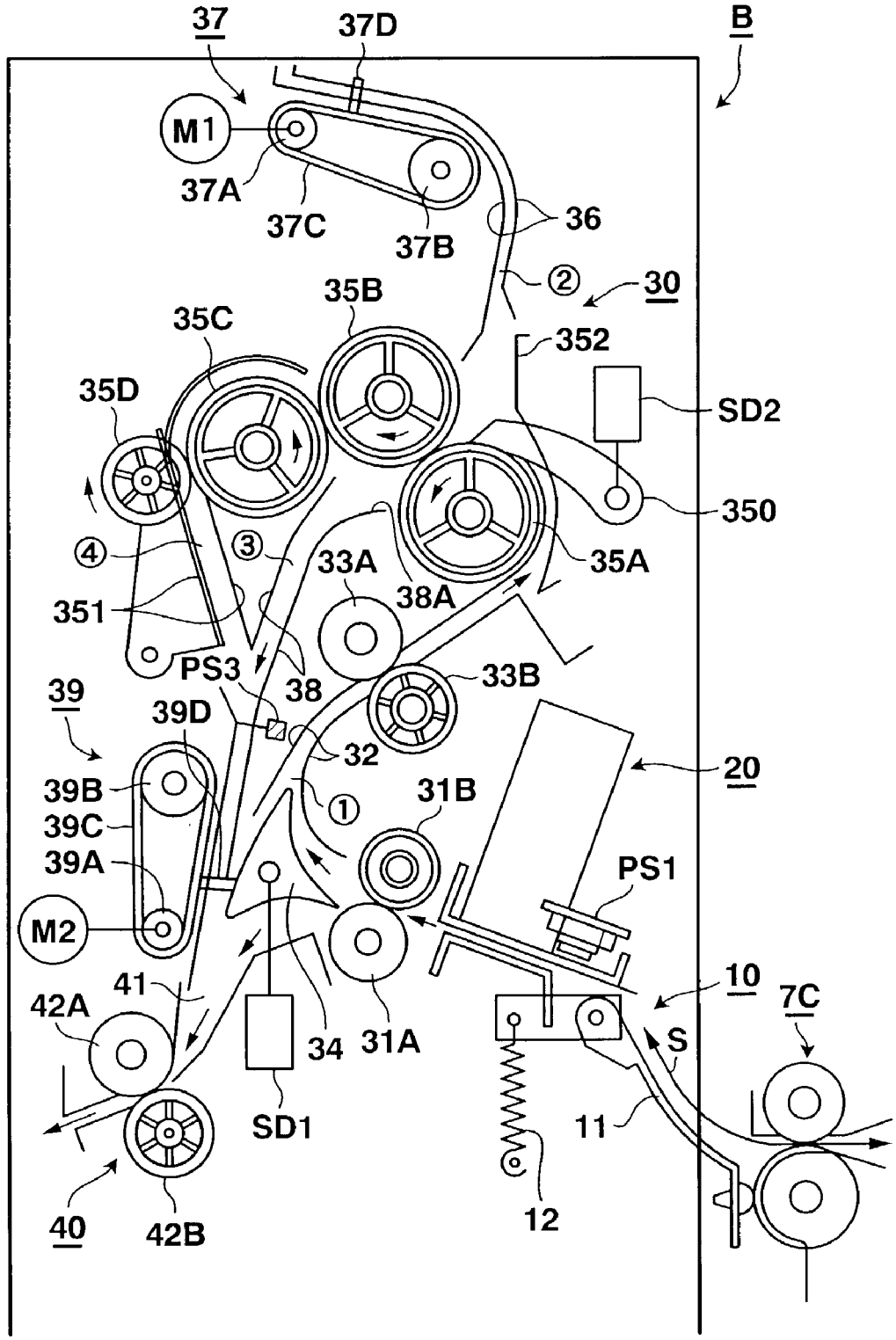
FIG. 4 is a sectional view showing the arrangement and sheet convey path of the first postprocessing apparatus.

(3-1) Simple Sheet Passing Process:

The switching means 34 provided to the first postprocessing apparatus B is rotated by the solenoid SD1 counterclockwise as shown in FIG. 4. The sheet S is conveyed from the inlet 10 by the registration rollers 31A and 31B, is guided to the delivery path 41 of the delivery means 40 by the switching means 34, is clamped by the delivery rollers 42A and 42B, and is conveyed to the second postprocessing apparatus C.

(3-2) Punching Process:

To punch a sheet which is short in the convey direction, e.g., a sheet S of A4 size or smaller than that, the sheet S introduced to the inlet 10 is conveyed by the registration rollers 31A and 31B and delivery rollers 42A and 42B for a predetermined length, and is temporarily stopped. The sheet S is then punched at a predetermined position by the first punching means 20, and is conveyed by the registration rollers 31A and 31B and delivery rollers 42A and 42B, so it is fed into the second postprocessing apparatus C.

To punch a sheet which is long in the convey direction, e.g., a sheet S of A4R or B4 size or larger than that at the vicinity of its trailing end, first, the switching means 34 is swung by the solenoid SD1, and a movable guide member 350 swingably supported in the vicinity of the first folding roller 35A is swung counterclockwise by a solenoid SD2, to close the second convey path ②. After this convey path is formed, the sheet S is conveyed by the registration rollers 31A and 31B. First, the sheet S is loaded into the first convey path ①, is conveyed by the intermediate convey rollers 33A and 33B, and is further guided by the movable guide member 350 to enter the clamping position of the first folding rollers 35A and 35B by rotation of the first folding rollers 35A and 35B in directions of arrows. In the mode of punching the sheet at its trailing end, the stepping motor M2 is actuated to move the second stopping means 39, thereby retreating the second stopping means 39 from the third convey path ③.

When the trailing end of the sheet S which is being conveyed through the third convey path ③ and delivery path 41 reaches the first punching means 20, the first folding rollers 35A and 35B, registration rollers 31A and 31B, and intermediate convey rollers 33A and 33B are stopped. The first punching means 20 is actuated to punch the sheet S at a predetermined position. Then, these rollers are rotated simultaneously to convey the sheet S. The sheet S is sent to the second postprocessing apparatus C by the delivery rollers 42A and 42B.

(3-3) Folding Process:

A folding mode and a sheet size are set, so the stepping motors M1 and M2 are driven by a control means (not shown) in accordance with the size information on the sheet S, to move the first and second stopping means 37 and 39 to positions corresponding to the sheet size. Furthermore, the switching means 34 is rotated to close the delivery path 41.

Upon start of the folding process, the sheet S sent from the image forming apparatus A is clamped by the registration rollers 31A and 31B and intermediate convey rollers 33A and 33B, and is conveyed through the first convey path ①. The sheet S then further enters the second convey path ② formed of the guide plates 36, so its leading end abuts against the abutting portion 37D of the first stopping means 37.

The intermediate convey rollers 33A and 33B continue rotation to forcibly convey the sheet S toward the first stopping means 37. Since the leading end of the sheet S is kept stopped by the abutting portion 37D, a flexing force acts on the sheet S between the first and second convey paths ① and ②. As a guide plate 352 is arranged on the right side shown in FIG. 4, the sheet S flexes toward the clamping position of the first folding rollers 35A and 35B, and the flexed portion of the sheet S enters the clamping position formed between the first folding rollers 35A and 35B. As the first folding rollers 35A and 35B rotate in the directions of arrows, the sheet S is conveyed while forming a first fold c.

Subsequently, the sheet S, on which the first fold c has been formed by the first folding rollers 35A and 35B, is conveyed, with its first fold c being the leading end, by the first folding rollers 35A and 35B through the third convey path ③ formed by the guide plates 38. The sheet S is stopped when its first fold c abuts against the abutting portion 39D of the second stopping means 39.

During this period of time, the first folding rollers 35A and 35B continue rotation. Hence, a flexing force acts on the sheet S between the first folding rollers 35A and 35B and the abutting portion 39D of the second stopping means 39. Guide portions 38A of the guide plates 38 prohibit the sheet S from flexing downward. Thus, the sheet S enters the clamping position formed between the first and second folding rollers 35B and 35C.

As the first folding roller 35B and second folding roller 35C rotate in the directions of arrows, the flexed portion of the sheet S is conveyed to between them, so the sheet S is conveyed while forming a second fold d.

The sheet S, on which the first and second folds c and d have been formed, travels along the third convey path ③ in the opposite direction due to the convey force caused by the first and second folding rollers 35B and 35C that press against each other, so its first fold c separates from the abutting portion 39D of the second stopping means 39. The stepping motor M2 starts driving upon reception of a signal from a sensor (not shown) that detects passing of the first fold c. When the stepping motor M2 is actuated, the abutting portion 39D of the second stopping means 39 moves to the lower side of the convey path to retreat from the third convey path ③ and the fourth convey path ④ (to be described later) which merges with it.

The sheet S folded in three is conveyed in this manner by the guide plates 351 and driven roller 35D along the outer surface of the second folding roller 35C, and travels downward along the fourth convey path ④. The sheet S then passes through the delivery path 41 and is sent to the second postprocessing apparatus C by the delivery rollers 42A and 42B with its second fold d being the leading end.

An example of the folding process of folding the sheet S in three to have a Z shape shown in FIG. 3B has been described so far. In the folding process of folding the sheet S in two, the first stopping means 37 is moved to the position for folding in two. After a sensor PS3 detects that the first fold c has passed through it, the abutting portion 39D driven by the stepping motor M2 retreats the second stopping means 39 to a position where it does not interfere with the convey path. Then, the sheet S is folded by the first folding rollers 35A and 35B. After that, the sheet S which is folded in two is delivered from the third convey path ③ to the second postprocessing apparatus C through the delivery path 41.

In the second convey path ② located upstream of the clamping position of the first folding rollers 35A and 35B, the sheet S is conveyed with a thickness corresponding to one sheet. In the third convey path ③ located downstream of the first folding rollers 35A and 35B, the sheet S is conveyed with a thickness corresponding to two sheets. In the fourth convey path ④ located downstream of the clamping position of the first folding roller 35B and second folding roller 35C, the sheet S is conveyed with a thickness corresponding to three sheets.

(4) Second Postprocessing Apparatus:

The second postprocessing apparatus C according to the present invention will be described with reference to FIGS. 5 to 19.

Figure 5:
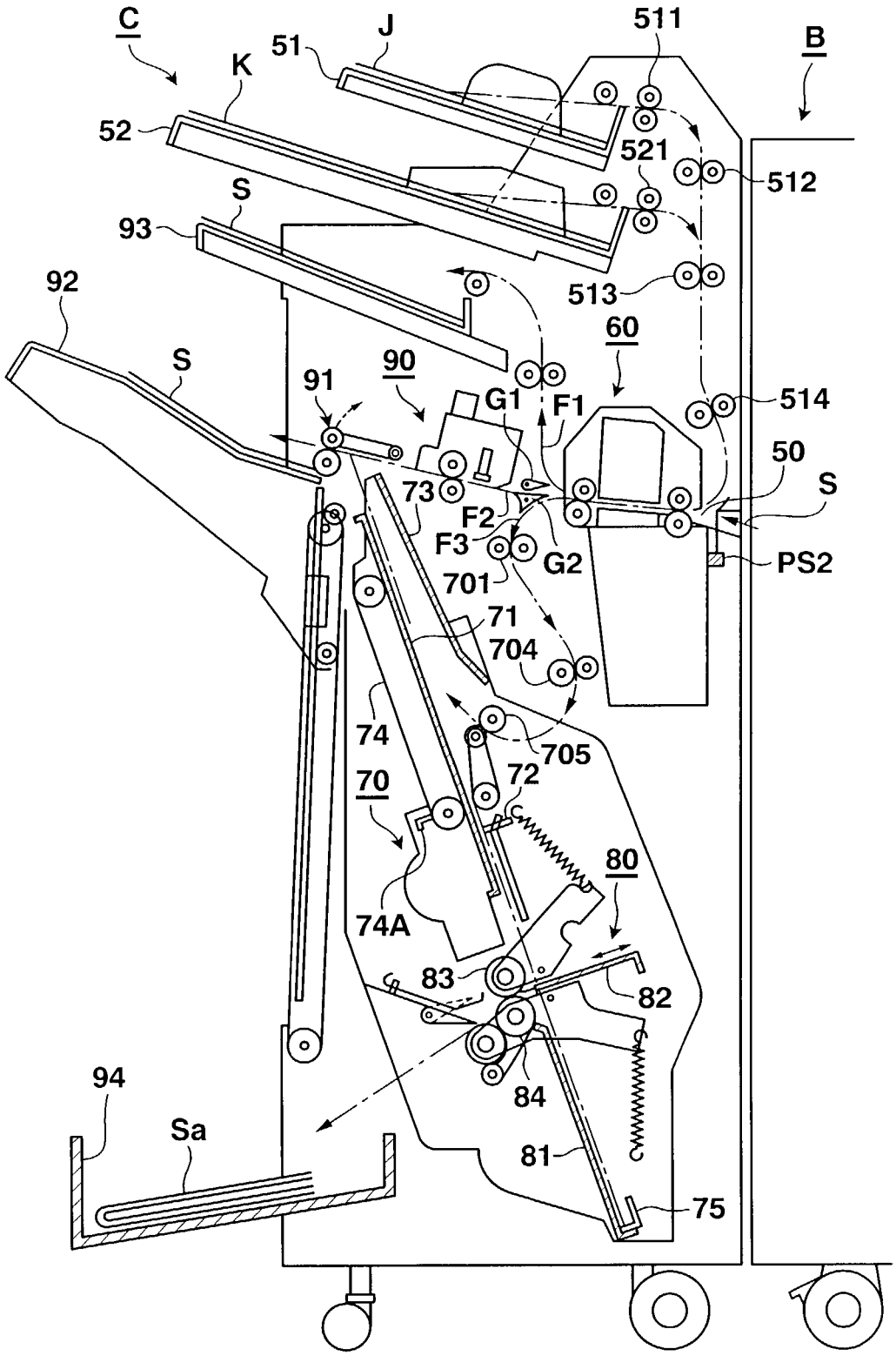
FIG. 5 is a sectional view showing a sheet convey path in the second postprocessing apparatus.
Figure 6:
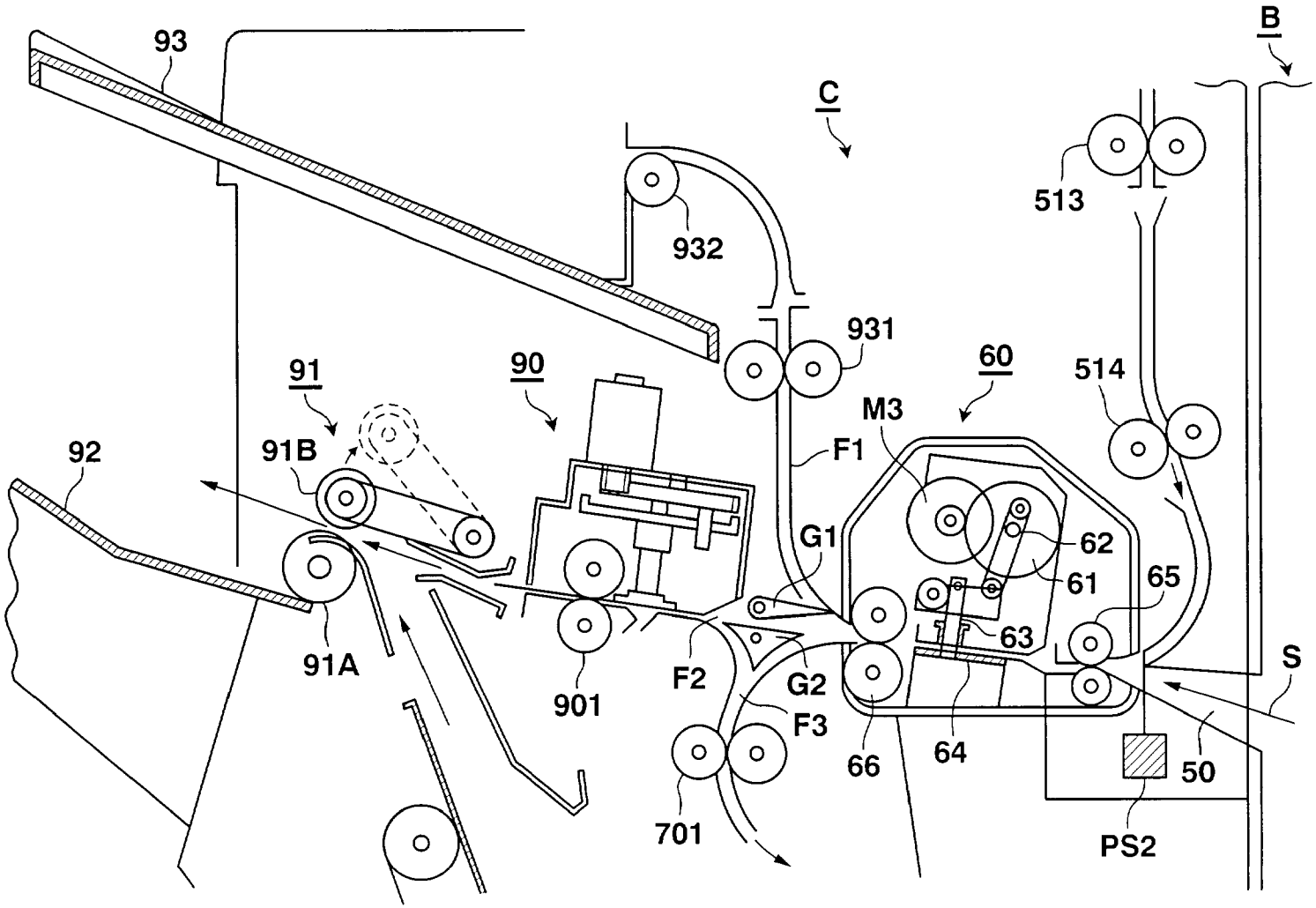
FIG. 6 is a sectional view of a second punching means, shift means, and delivery means arranged in the second postprocessing apparatus.

As shown in FIGS. 5 and 6, in the second postprocessing apparatus C, the first feeder 51, second feeder 52, and upper delivery table 93 are arranged at the upper stage. The second punching means 60, shift means 90, and delivery means 91 are arranged in series at the intermediate stage to form one substantially horizontal plane. The stitching means (staple means) 70 and second folding means 80 are arranged in series at the lower stage to form one inclined plane.

The vertically movable delivery table 92 for stacking shifted sheets and a bundle of end-bound sheets thereon, and the lower delivery table 94 for stacking a bundle of sheets folded in three or two are arranged on the left side surface, in FIGS. 5 and 6, of the second postprocessing apparatus C.

The sheet S which is punched and folded by the first postprocessing apparatus B is introduced to the inlet 50 of the second postprocessing apparatus C. Insert paper J, which is supplied from the first feeder 51 set on the upper portion of the second postprocessing apparatus C to divide the bundle of sheets, and cover paper K, which is supplied from the second feeder 52, are introduced to the inlet 50. A sensor PS2 for detecting that the leading end of the sheet S has passed through it is arranged in the vicinity of the inlet 10.

The respective means of the second postprocessing apparatus C, their operations, and the respective processes will be described hereinafter.

(4-1) Feed Means:

As is apparent from FIG. 5, the insert paper J stored in the sheet tray of the first feeder 51 is separated and fed by feed rollers 511 and then clamped by convey rollers 512, 513, and 514 so it is introduced to the inlet 50. The cover paper K stored in the sheet tray of the second feeder 52 is separated and fed by feed rollers 521 and then clamped by the convey rollers 513 and 514 so it is introduced to the inlet 50.

(4-2) Second Punching Means

As shown in FIG. 6, the second punching means 60 is arranged downstream of the inlet 50 in the sheet convey direction. The second punching means 60 has a circular plate 61 rotatably driven by a motor M3 as the driving source, a crank 62 with one end locked to the eccentric position of the circular plate 61, a punch 63 vertically driven by the crank 62, and a die 64 to fit with the blade of the punch 63. Registration rollers 65 are arranged upstream of the punching position of the punch 63 and die 64 in the sheet convey direction. Convey rollers 66 are arranged downstream of the punching position in the sheet convey direction.

(4-3) Sheet Branching Means:

As is apparent from FIG. 6, a sheet branching means comprised of switching gates G1 and G2 is formed downstream of the second punching means 60 in the sheet convey direction. The switching gates G1 and G2 selectively branch the sheet S to sheet convey paths in three directions by the driving operation of a solenoid (not shown), that is, to either one of a first convey path F1 reaching the upper delivery table 93, a second convey path F2 reaching the shift means 90 of the intermediate stage, and a third convey path F3 reaching the stitching means 70 of the lower stage.

(4-4) Simple Delivery Process:

When this sheet convey is set, the switching gate G1 opens only the first convey path F1 and closes the other second and third convey paths F2 and F3.

The sheets S passing through the first convey path F1 move upward as they are clamped by convey rollers 931, are delivered by a delivery roller 932, and are placed on the upper delivery table 93, so they are sequentially stacked on it. When punching the sheet S, the second punching means 60 is actuated. About 200 sheets S at maximum can be stacked on the upper delivery table 93.

(4-5) Shift Processing:

When this convey mode is set, the switching gate G1 retreats upward, and the switching gate G2 closes and opens the third and second convey paths F3 and F2, respectively, to enable passing of the sheet S. The sheet S passes between the switching gates G1 and G2.

The sheet S delivered from the first postprocessing apparatus B, the insert paper J fed from the first feeder 51, or the cover paper K fed from the second feeder 52 passes through the intermediate sheet path between the switching gates G1 and G2, is shifted by the shift means 90 in a direction perpendicular to the sheet convey direction, and is conveyed by convey rollers 901.

The shift means 90 performs the shift process of changing the delivery position of the sheet S in the convey width direction every time a predetermined number of sheets are delivered. The shift-processed sheets S are delivered by the delivery means 91 to the vertically movable delivery table 92 outside the apparatus and are sequentially stacked on it. When a large number of sheets S are to be delivered, the vertically movable delivery table 92 gradually moves down. The vertically movable delivery table 92 can store about 3,000 (A4 or B5) sheets S at maximum.

(4-6) Stitching Process:

When the stitching process or folding process is set by the operating portion 9 of the image forming apparatus A, the sheet S, on which an image has been formed in the image forming apparatus A and which is sent to the inlet 50 of the second postprocessing apparatus C through the first postprocessing apparatus B, passes through the second punching means 60 and is sent to the third convey path F3 below the switching gate G2. The sheet S is then conveyed as it is clamped by convey rollers 701 and 704, and is stopped when its leading end abuts against a portion in the vicinity of the clamping position of registration rollers 705. Hence, the leading end of the sheet S is aligned.

Figure 7:
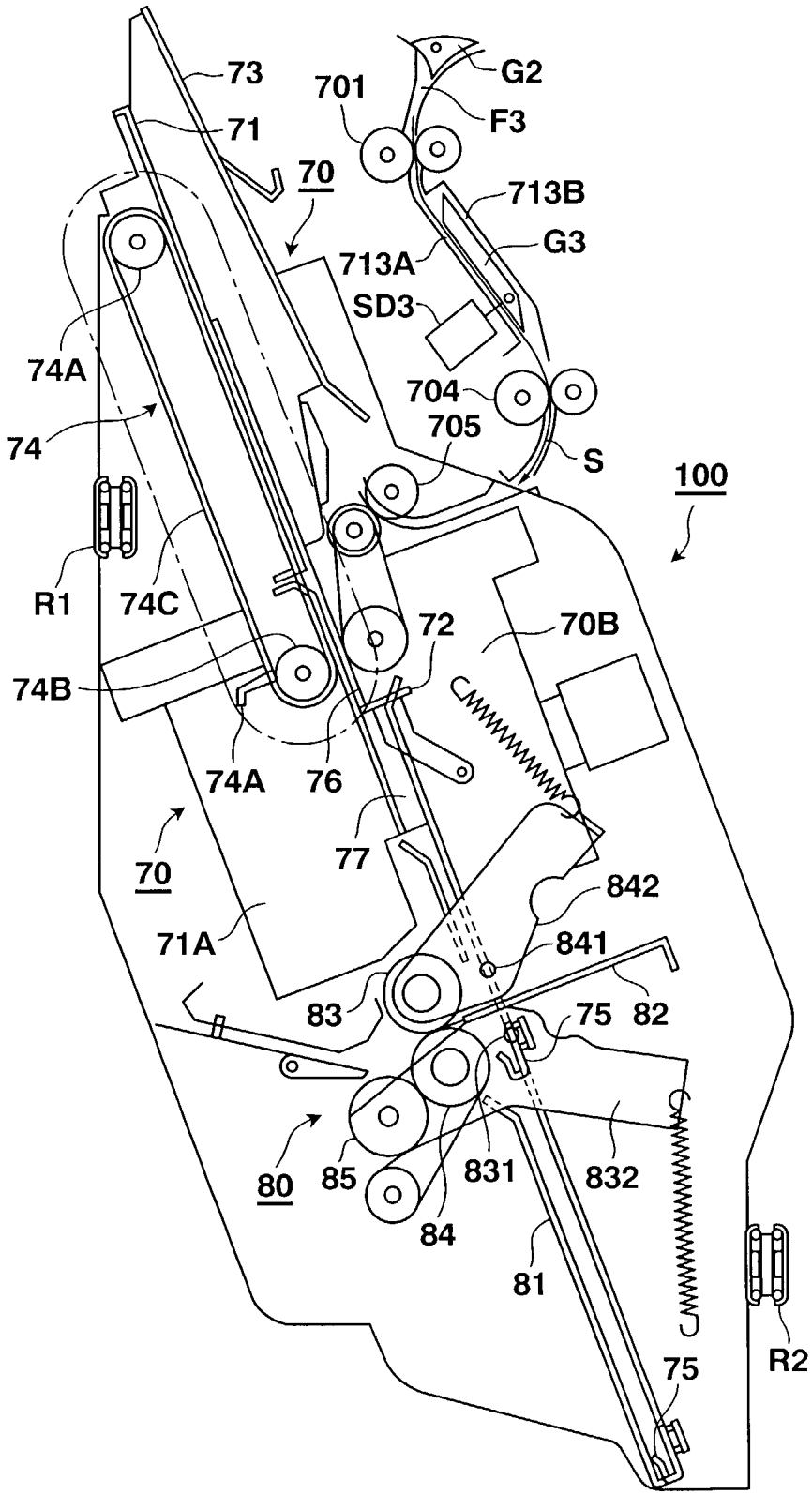
FIG. 7 is a sectional view of a stitching unit formed of a stitching means and folding means.

As shown in FIG. 7, when a sheet S with a size larger than A4 or B5 is to be conveyed along the third convey path F3, a solenoid SD3 is driven, so the sheet S passes through a sheet path 713A on the left side of the switching gate G3 in FIG. 7, and is conveyed downward as it is clamped by the convey rollers 704. The sheet S is then clamped and fed by the registration rollers 705 on the further downstream side, and is delivered to a space above an intermediate stacker (frame) 71 which is arranged inclinedly. The sheet S comes into contact with the intermediate stacker 71 or the upper surface of the sheets S stacked on the intermediate stacker 71, and is conveyed obliquely upward. After the trailing end of the sheet S in the traveling direction is delivered from the clamping position of the convey rollers 704, the sheet S starts to move downward due to its own weight. The sheet S is conveyed on the inclined surface of the intermediate stacker 71, and is stopped when its trailing end abuts against the sheet abutting surface of an end stitching movable stopper member (to be referred to as an end stitching stopper hereinafter) 72 in the vicinity of the stitching means (staple means) 70.

A movable switching gate G3 and a sheet path 713B which is parallel to the sheet path 713A on the left side of the e switching gate G3 in FIG. 7 are provided to the third convey path F3, so small-size sheets S such as A4 or B5 sheets are conveyed efficiently continuously, thus improving the copying productivity.

When the solenoid SD3 connected to the switching gate G3 is driven, the sheet path 713A is closed while the sheet path 713B is opened.

The leading end of a first small-size sheet S sent from the convey rollers 701 passes through the sheet path 713B and is stopped when it abuts against the outer surfaces of the registration rollers 705 which are in the stop state.

Then, power supply to the solenoid SD3 is turned off. The leading end of the switching gate G3 swings clockwise to close and open the sheet paths 713B and 713A, respectively. The leading end of a second sheet S sent from the convey rollers 701 passes through the sheet path 713A and is stopped when it abuts against the outer surfaces of the registration rollers 705 which are in the stop state. Accordingly, in the vicinity of the clamping position of the registration rollers 705, the first and second sheets S are stopped with their leading ends being in the overlapping state, so the sheets S are set in the wait state.

The registration rollers 705 are rotatably driven at a predetermined timing, to clamp and convey the two sheets S simultaneously, thus delivering them onto the intermediate stacker 71. From the third sheet, the convey rollers 701 deliver sheets S one by one.

Reference numeral 73 denotes a pair of width aligning members movably formed on the two side surfaces of the intermediate stacker 71. The width aligning members 73 can move in a direction perpendicular to the sheet convey direction. In the sheet accepting mode wherein the sheet S is to be conveyed onto the intermediate stacker 71, the width aligning members 73 are opened wider than the sheet width. When the sheet S is conveyed on the intermediate stacker 71 and abuts against the end stitching stopper 72 so it is stopped there, the width aligning members 73 lightly strike the sides in the widthwise direction of the sheet S to jog the width of a bundle Sa of sheets (width alignment). At this stop position, when a predetermined number of sheets S are stacked and aligned on the intermediate stacker 71, the stitching means 70 performs switching, so the bundle Sa of sheets is bound together.

A notch is formed in part of the sheet stacking surface of the intermediate stacker 71, and a plurality of delivery belts 74C wound on a driving pulley 74A and driven pulley 74B are rotatably driven. A delivery pawl 74D is integrally formed on part of each delivery belt 74C, and its distal end forms an elliptic trace, as indicated by an alternate long and short dashed line in FIG. 7. The stitched bundle Sa of sheets is placed on the delivery belts 74C as the trailing ends of the sheets S are held by the delivery pawls 74D of the delivery belts 74C. The sheets S slide on the placing surface of the intermediate stacker 71 and are pushed obliquely upward to travel to the clamping position of delivery rollers 91A and 91B of the delivery means 91. The bundle Sa of sheets clamped by the rotating delivery roller 91B is delivered onto the vertically movable delivery table 92 and stacked there.

Figure 8A:
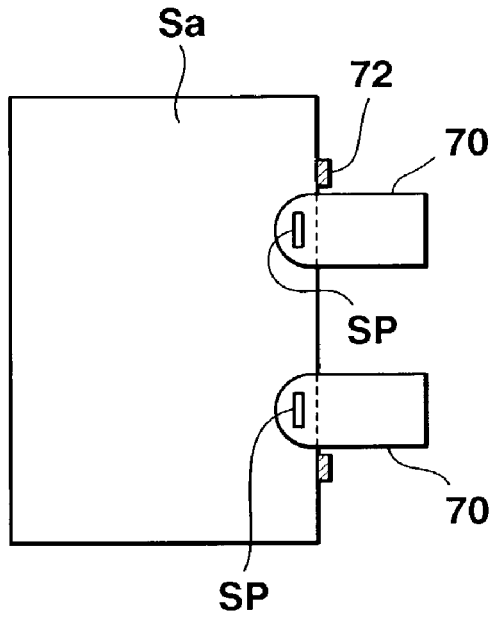
FIGS. 8A and 8B are plan views of a side stitching process and end stitching process, respectively.
Figure 8B:
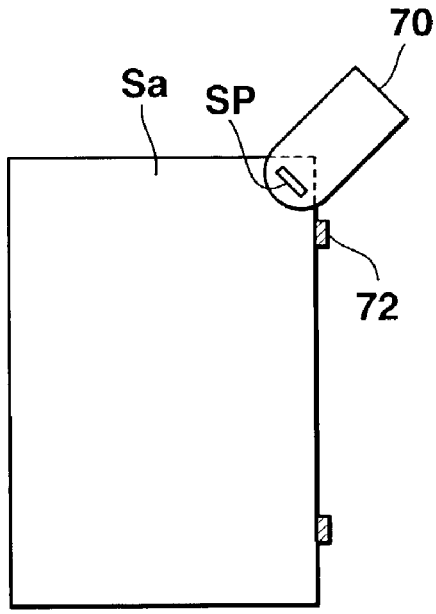

FIG. 8A is a plan view showing a side stitching process of stitching a sheet S with staples SP at its two portions divided at the center, which are in the vicinity of the side end, and FIG. 8B is a plan view showing an end stitching process of stitching a sheet S with a staple SP at its one portion which is in the vicinity of the corner.

(4-7) Saddle Stitching Process:

As shown in FIG. 7, the intermediate stacker 71 for placing the bundle Sa of sheets thereon, the stitching means 70, and the second folding means 80 are arranged on the frame of a stitching unit 100, and are introduced by guide rails R1 and R2, so they can be withdrawn to the front side of the second postprocessing apparatus C.

The stitching means 70 is arranged on each side of a direction perpendicular to the sheet convey direction, and can be moved by a driving means (not shown) in the direction perpendicular to the sheet convey direction. These stitching means 70 bind the sheet S with the staples SP at its two portions divided at the center in the widthwise direction of the sheet (see FIG. 8A).

The stitching means 70 are swingably, rotatably supported, and stitch the sheet S with a staple SP at its corner in accordance with the sheet size (see FIG. 8B).

When the saddle stitching mode is set, the end stitching stopper 72 in the vicinity of the stitching positions (stapling positions of the staples) of the stitching means 70 retreats from the convey path. Almost simultaneously, a saddle-stitching/center-folding movable stopper member (to be referred to as a saddle-stitching center-folding stopper hereinafter) 75 downstream of the end stitching stopper 72 moves toward the extension surface of a sheet path 76, to close a sheet path 77.

When the sizes (lengths in the convey direction) of the cover paper K and sheets S are set or detected, a saddle-stitching stopper unit having the saddle-stitching center-folding stopper 75 moves to a position where it abuts against the lower end of the bundle Sa of sheets to be saddle-stitched, and is stopped.

After the cover paper K is placed at a predetermined stop position on the intermediate stacker 71, the sheets S unloaded from the image forming apparatus A pass through the third convey path F3 from the inlet 50 of the second postprocessing apparatus C and are sequentially stacked on the upper surface of the cover paper K placed on the intermediate stacker 71. The leading ends of the sheets S abut against the saddle-stitching center-folding stopper 75, so the sheets S are positioned.

After the last sheet S is positioned and placed on the intermediate stacker 71, the bundle Sa of sheets comprised of the cover paper K and all pages of the sheets S are saddle-stitched by the stitching means 70. By means of the saddle stitching process, the cover paper K and sheets S are bound with the staple SP at their centers in the convey direction. The staple SP is inserted by a stapling mechanism 70A on the staple driving side toward a wire receiving mechanism on the staple clinch side.

(4-8) Process of Folding in Two:

The process of folding in two will be described with reference to FIGS. 9 to 12D.

After the saddle stitching process, the saddle-stitching center-folding stopper 75 linearly moves toward the downstream in the convey direction of the bundle Sa of sheets to open the downstream path of the sheet path 76. The movable saddle-stitching center-folding stopper 75 regulates the stop position of the bundle Sa of sheets in the saddle stitching process at the upper position, and regulates the stop position of the bundle Sa of sheets in the center folding process at the lower position.

The bundle Sa of sheets comprised of the saddle-stitched cover paper K and sheets S is conveyed as it is guided obliquely downward by a guide plate (frame) 81. The end of the bundle Sa of sheets in the convey direction abuts against the saddle-stitching center-folding stopper 75, so the bundle Sa of sheets is stopped at a predetermined position. The saddle-stitching center-folding stopper 75 can be moved to the predetermined position in accordance with the sheet size setting operation or detection result and by a driving means.

The sheet paths of the upstream intermediate stacker 71 and of the downstream guide plate 81, which form the sheet convey path of the stitching unit 100, form substantially one flat plane with a sharp inclination of 10° to 30°.

Figure 9:
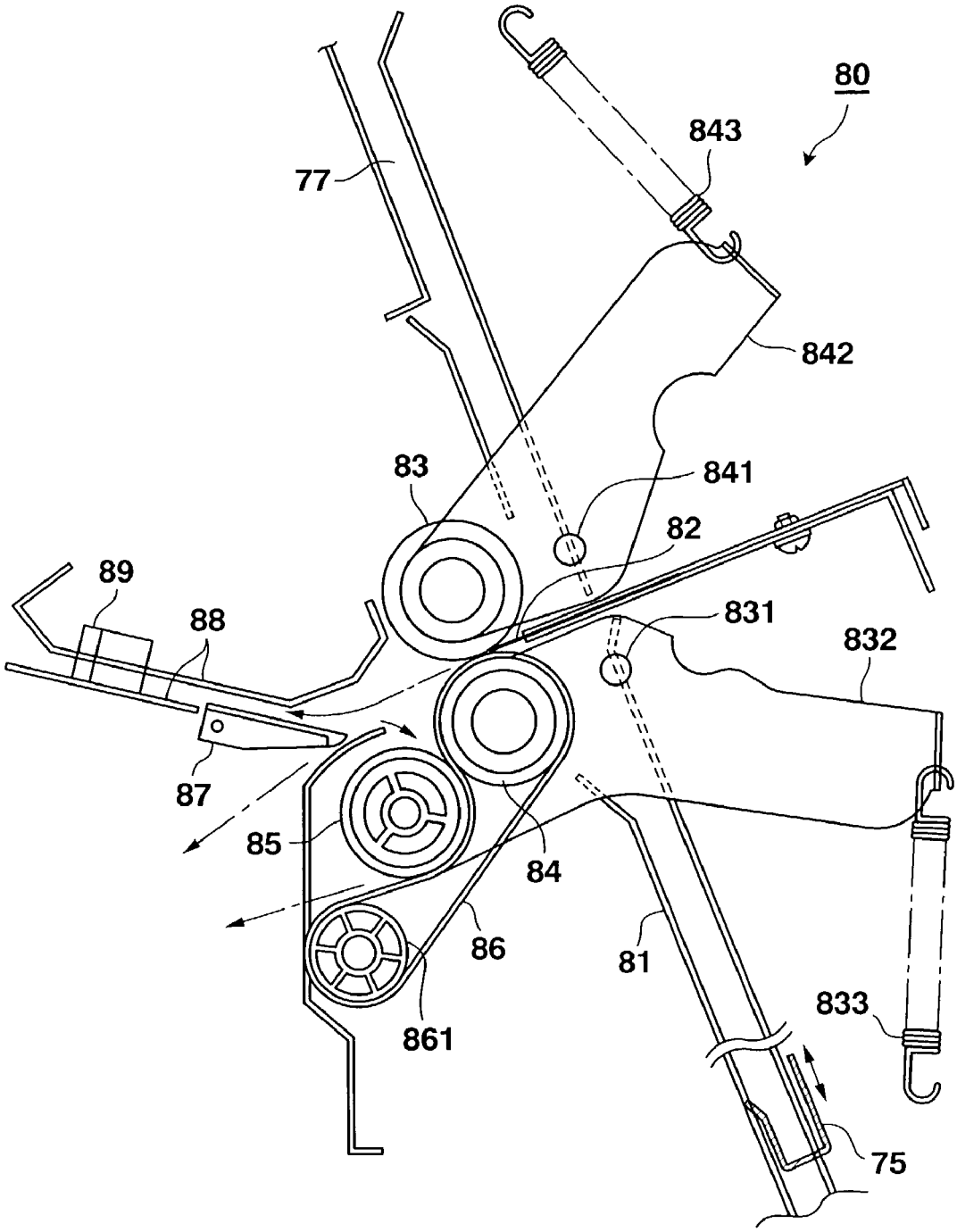
FIG. 9 is a front view of the folding means.

A projecting plate 82 of the folding means 80 is set at the center of the stopped bundle Sa of sheets in the convey direction, i.e., on the right side in FIG. 9 of the center folding position. A pair of first folding rollers 83 and 84 are set on the left side in FIG. 9 of the center folding position. The surfaces of the first folding rollers 83 and 84 are made of a material with a high frictional resistance e.g., rubber.

The folding means 80 is formed of the projecting plate 82, the first folding rollers 83 and 84, a delivery means, and the like.

Figure 10A:
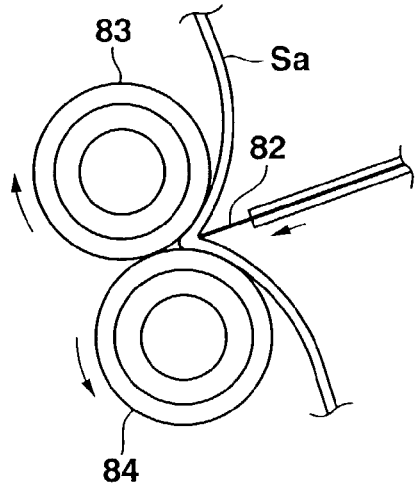
FIGS. 10A to 10C are sectional views showing the steps in the two-fold process of the folding means.
Figure 10B:
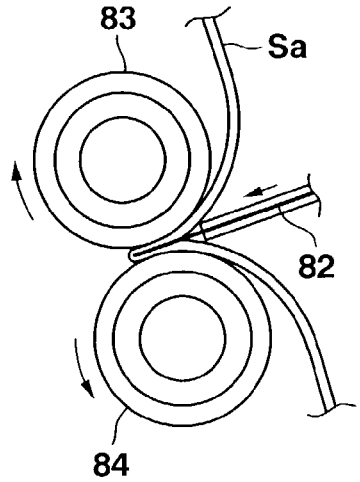
Figure 10C:
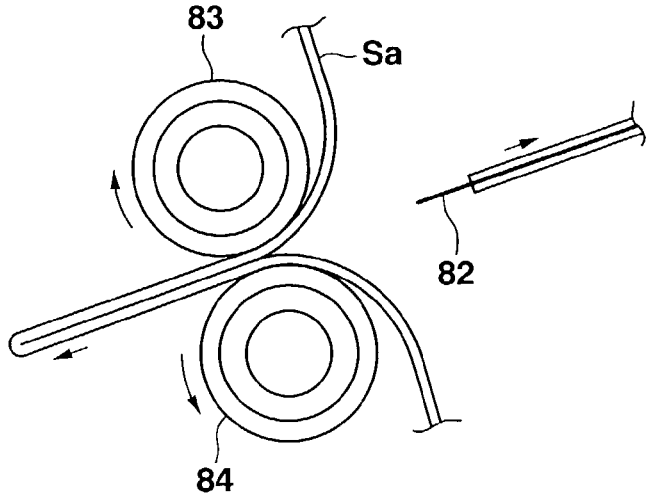

FIGS. 10A to 10C are sectional views showing the steps in the two-fold process of the folding means 80. FIG. 10A shows a state wherein the projecting plate 82 pushes the bundle Sa of sheets so it presses against the first folding rollers 83 and 84. FIG. 10B shows a state wherein the projecting plate 82 enters a position across the clamping position of the first folding rollers 83 and 84 to fold the bundle Sa of sheets in two. FIG. 10C shows a state wherein the projecting plate 82 retreats from the clamping position of the first folding rollers 83 and 84 so as to be returned to the initial position, and the bundle Sa of sheets folded in two is delivered by the first folding rollers 83 and 84.

Upon reception of a two-fold process start signal, the projecting plate 82 connected to a driving source projects to the left in FIG. 10A through the sheet placing surface. The projecting plate 82 forms a thin knife-like shape and has a sharp distal end.

The distal end of the projecting plate 82 which has linearly moved and projected to the left in FIG. 10A pushes in the center of the bundle Sa of sheets comprised of the cover paper K and sheets S and widens the clamping portion of the first folding rollers 83 and 84 which is rotatably driven through the bundle Sa of sheets, so the first folding rollers 83 and 84 are separated apart.

After the distal end of the projecting plate 82 passes through the clamping portion of the first folding rollers 83 and 84, it is moved backward, and the center of the bundle Sa of sheets is clamped by the first folding rollers 83 and 84, to form a fold. This fold substantially corresponds to the stitching position of the bundle Sa of sheets with the staple SP by the saddle stitching process.

The first folding rollers 83 and 84 are formed of a pair of left and right pressing means which are substantially symmetric. One pressing means is formed of the first folding roller 84 connected to the driving source and driven by it, a support plate 832 for rotatably supporting the first folding roller 84 and swingable about a support shaft 831 as the center, and a spring 833 locked at one end of the support plate 832 and biasing the first folding roller 84 toward the clamping position. The first folding roller 83 is substantially symmetric with the first folding roller 84, and is formed of a support shaft 841, support plate 842, and spring 843.

The bundle Sa of sheets, which is clamped to form a fold, is unloaded along the guide member by the pair of rotatably driven first folding rollers 83 and 84, and is placed on the stationary delivery table 94 outside the apparatus.

Figure 11:
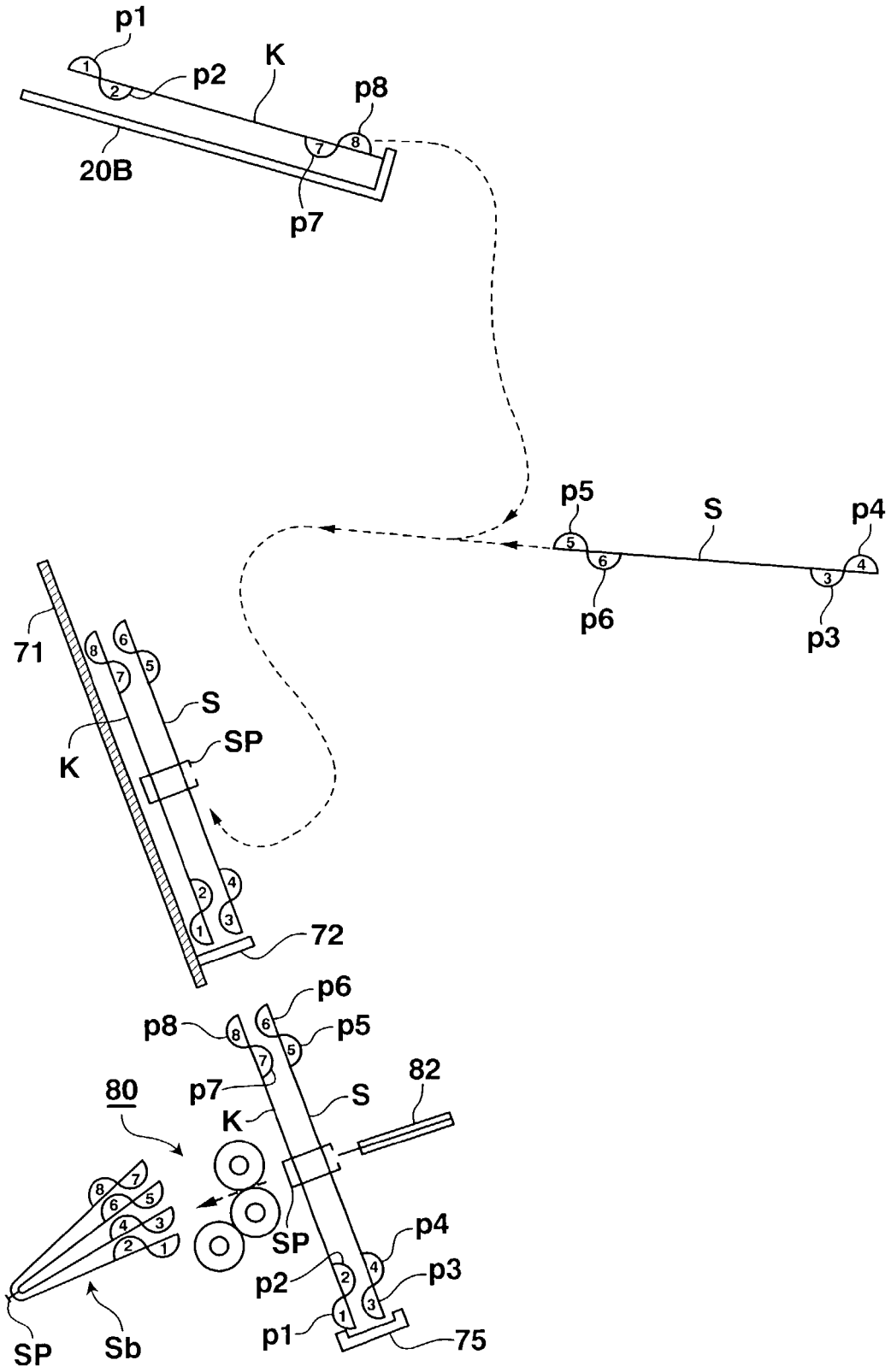
FIG. 11 is a schematic view showing the convey paths of cover paper and of sheets, the process of saddle stitching a bundle of sheets, and the process of folding it in two.
Figure 12A:
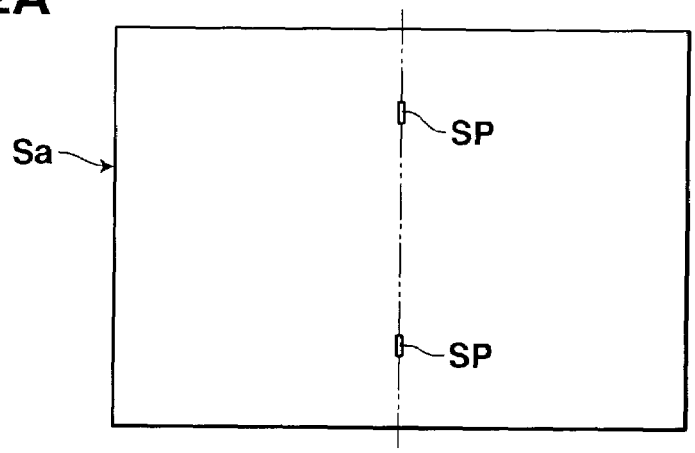
FIG. 12A is a plan view of saddle-stitched sheets.
Figure 12B:
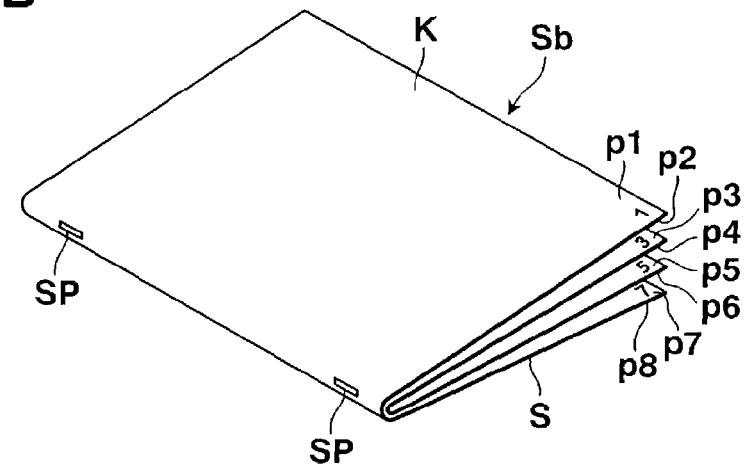
FIG. 12B is a perspective view of a booklet postprocessed by saddle stitching and folding in two.
Figure 12C:
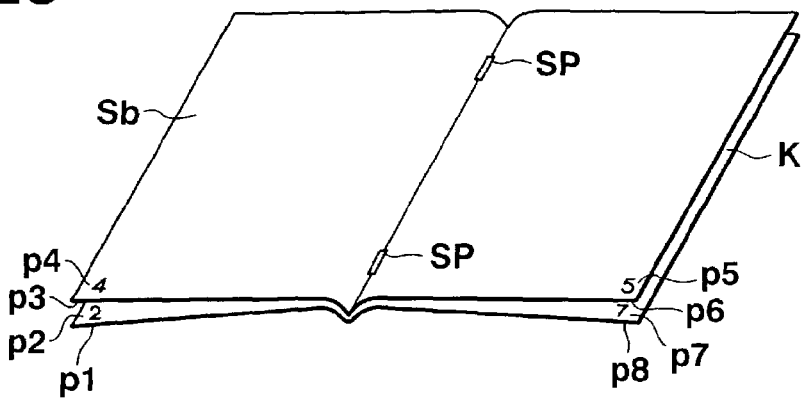
FIG. 12C is a perspective view showing a state wherein the postprocessed booklet is opened apart.
Figure 12D:
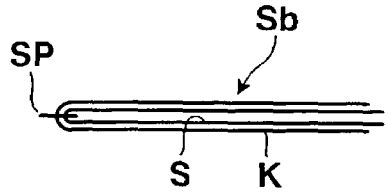
FIG. 12D is a schematic sectional view of the booklet.

FIG. 11 is a schematic view showing the convey path of cover paper K and of sheets S, the process of saddle-stitching the bundle Sa of sheets, and the process of folding it in two. FIG. 12A is a plan view showing the saddle stitching process of stitching the sheets S with staples SP at its two portions divided at the center along the fold formed by folding in two, FIG. 12B is a perspective view of a booklet Sb postprocessed by saddle stitching and folding in two, FIG. 12C is a perspective view showing a state wherein the postprocessed booklet Sb is opened apart, and FIG. 12D is a schematic sectional view of the booklet Sb.

The cover paper K is placed on the feeder table of the second feeder 52 with its first surface (pages 1 and 8) being on the upper side. The cover paper K fed from the second feeder 52 by the feeding means is conveyed through the second punching means 60 and third convey path F3, and is placed on the intermediate stacker 71 with its first surface (pages 1 and 8) being on the lower side.

An image-bearing sheet S is introduced to a postprocessing apparatus FS with its first surface (pages 3 and 6) being on the lower side. The sheet S is conveyed from the inlet 50 to the third convey path F3 through the second punching means 60, and is placed on the cover paper K placed on the intermediate stacker 71, with its first surface being on the lower side.

The cover paper K and sheet S are aligned on the intermediate stacker 71 and are bound with the staples SP by the stitching means 70, so they are saddle-stitched.

The bundle of saddle-stitched sheets is placed such that the first surface (pages 3 and 6) of the sheet S is on the upper side and that the first surface (pages 1 and 8) of the cover paper K on the sheet S is on the upper side.

The process of folding in two is performed by the pushup operation of the projecting plate 82 and the rotatable driving operation of the first folding rollers 83 and 84, and the bundle of sheets is conveyed and delivered onto the stationary delivery table 94 outside the apparatus.

In the booklet Sb formed by the process of saddle stitching and the process of folding in two, the first surface (pages 1 and 8) of the cover paper K faces outwardly, the second surface (pages 2 and 7) of the cover paper K is arranged on the lower side of the first page (pages 1 and 8), the first surface (pages 3 and 6) of the sheet S as the content is arranged inside the second page (pages 2 and 7), and the second surface (pages 4 and 5) of the sheets S is arranged inside the first surface (pages 3 and 6). Thus, the pages of the booklet Sb formed of 8 pages (pages 1 to 8) can be aligned as shown in FIGS. 12A to 12D.

At the operating portion 9 of the image forming apparatus A, assume that the auto booklet formation mode is selected and set, that cover paper K is stacked on the second feeder 52, and that printing is started. The image forming process described above is performed by the controller of the image forming apparatus A. The sheet S with an image is saddle-stitched and folded in two by the second postprocessing apparatus C. Hence, booklets Sb are formed and delivered continuously.

At the operating portion of the postprocessing apparatus FS, assume that the manual booklet formation mode is selected and set, that cover paper K and sheets S for one booklet, on which images are formed by another image forming means, are stacked on the second feeder 52, and that the feedout operation is started. The cover paper K and sheets S are saddle-stitched and folded in two by the controller of the second postprocessing apparatus C. Hence, one booklet Sb is formed and delivered.

In this embodiment, the folding means 80 is arranged along a sheet path having the same inclination as that of the intermediate stacker 71 which forms the stitching means 70.

(4-9) Process of Folding in Three:

The folding means 80 shown in FIG. 9 can perform two modes, i.e., the process of folding in two and the process of folding in three. The folding means 80 has a first folding means for folding the bundle Sa of sheets in two, and a second folding means for folding the bundle Sa of sheets in three.

The first folding means is formed of the first folding rollers 83 and 84 and the projecting plate 82. The second folding means is formed of a second folding roller 85, a convey belt 86, a convey switching member 87, guide plates 88, and a sheet leading end stopping member 89.

The position of the sheet leading end stopping member 89 is set such that the sheet convey distance from the clamping position of the first folding rollers 83 and 84 to the sheet abutting surface of the sheet leading end stopping member 89 is one third the length of the sheet S in the convey direction.

The first and second folding rollers 84 and 85 are rotatably supported by the support plate 832 and are connected to a driving means (not shown). The convey belt 86 is wound around the outer surfaces of the first and second folding rollers 83 and 85 and that of a tension roller 861.

Figure 13A:
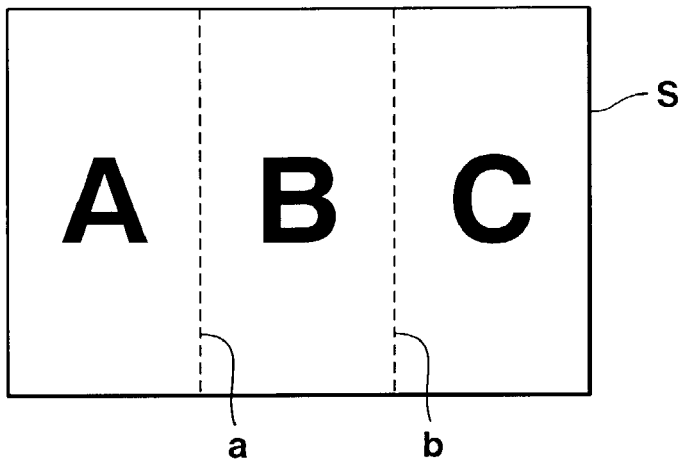
FIG. 13A is a plan view of a sheet to be folded in three.
Figure 13B:
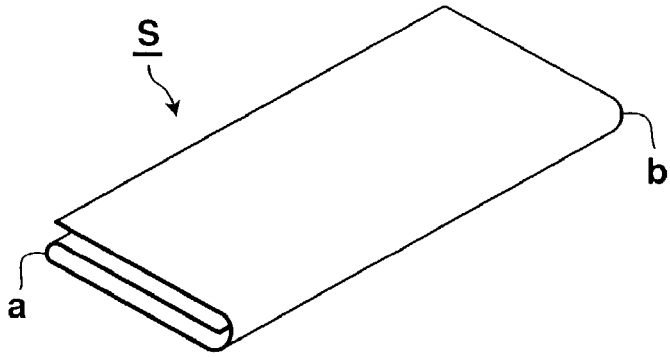
FIG. 13B is a perspective view of the sheet folded in three.

FIG. 13A is a plan view of a sheet S to be folded in three, and FIG. 13B is a perspective view of the sheet S folded in three. The sheet S is folded into three surfaces A, B, and C, at folding lines a and b that almost equally divide in three the length in the longitudinal direction of the sheet S. The sheet S to be folded in three is first folded at the folding line a and then folded inwardly at the folding line b.

Figure 13C:
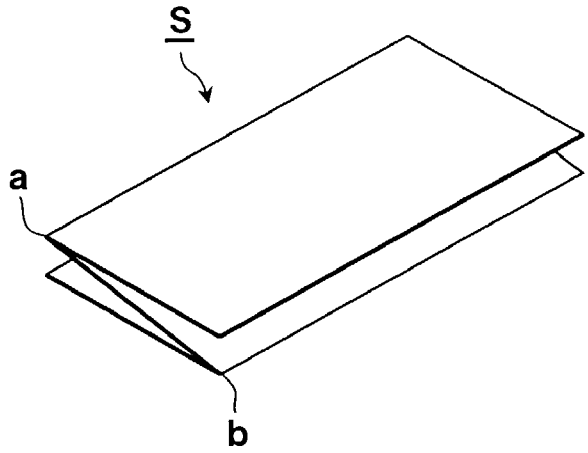
FIG. 13C is a perspective view of a sheet folded in three to have a Z shape.

FIG. 13C is a perspective view of a sheet S folded in three to have a Z shape. The sheet S to be folded in three is first folded at a folding line b and then folded outwardly at a folding line a.

The process of folding in three can fold a small number of sheets, e.g., about three sheets S, simultaneously. The sheets S folded in three can be further folded into a small size so they can be put in the envelope of ordinary mail.

FIGS. 14 to 18 are sectional views showing the steps in the three-fold process. With the process of folding in three, inward folding shown in FIG. 13B is performed. When folding in three into a Z shape is to be performed, the position of the saddle-stitching center-folding stopper 75 is altered, so the fold b is formed by the first folding rollers 83 and 84.

Figure 14:
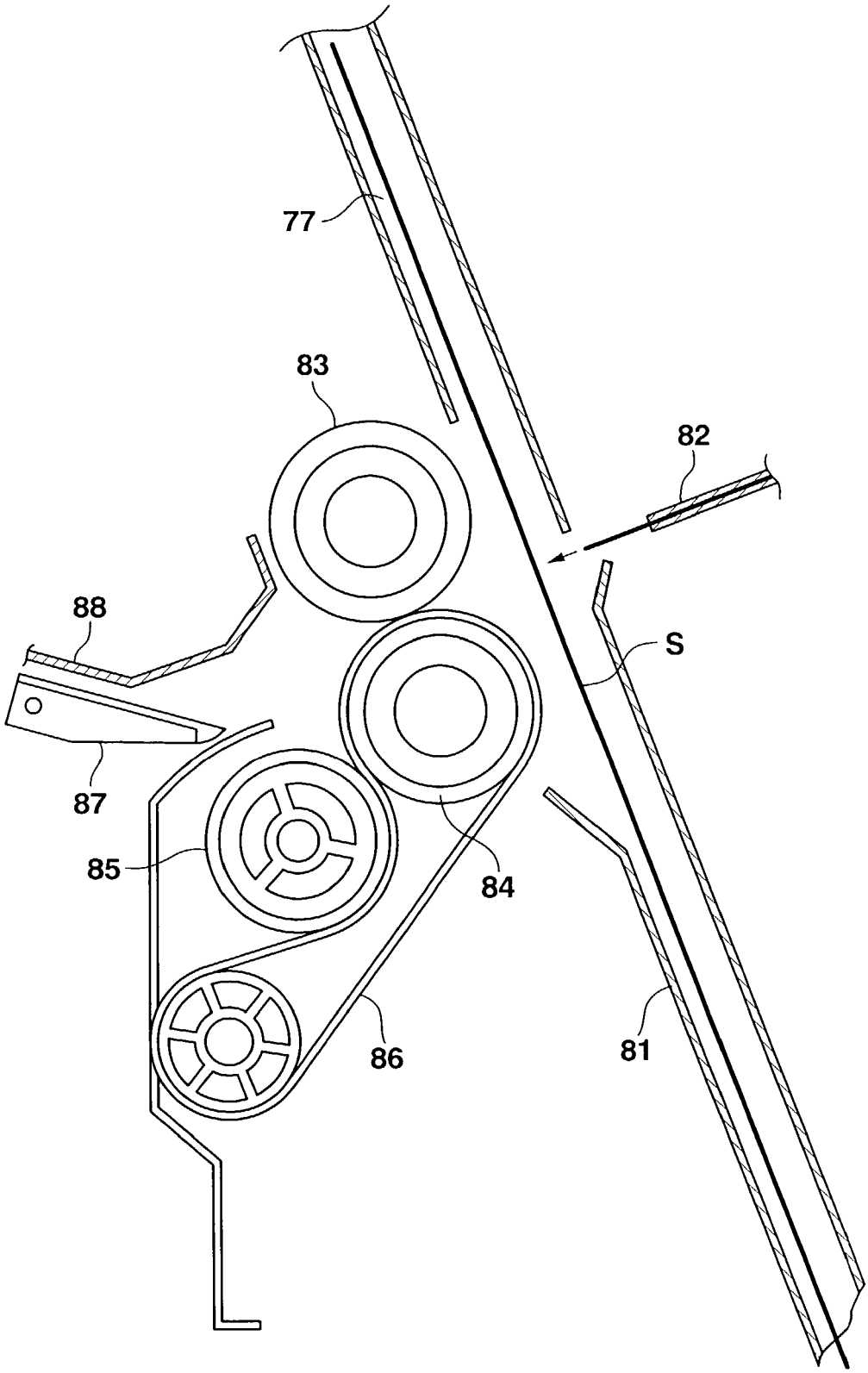
FIGS. 14 to 18 are sectional views showing the steps in the three-fold process.

(a) In FIG. 14, the sheet S is fed to inside the guide plate 81. As shown in FIG. 9, the leading end of the sheet S abuts against the saddle-stitching center-folding stopper 75 which is position-adjusted in accordance with the size of the sheet S, so the sheet S is stopped. The stop position of the sheet S is where a fold a with which the sheet S is folded in three coincides with the position of the distal end of the projecting plate 82.

Figure 15:
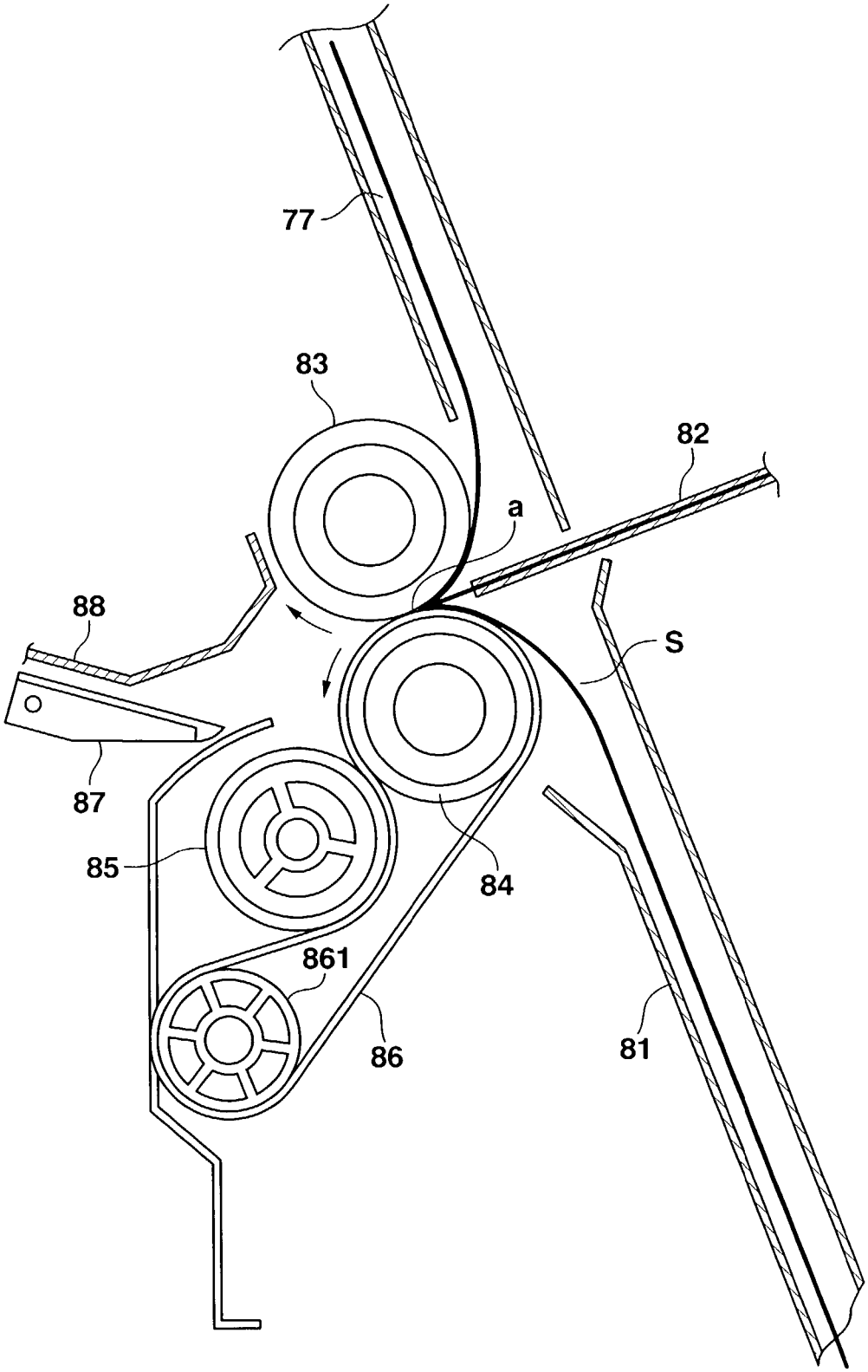

(b) As shown in FIG. 15, the distal end of the projecting plate 82 presses the fold a formed on the sheet S to insert it into the clamping position of the first folding rollers 83 and 84. The first folding rollers 83 and 84 are driven to rotate in directions indicated by solid arrows to clamp the sheet S while forming the fold a on the sheet S. At this time, the convey switching member 87 is stopped at that position where it opens the sheet path of the guide plates 88. After the first folding rollers 83 and 84 form the fold a, the projecting plate 82 retreats from the clamping position and returns to the initial position.

Figure 16:
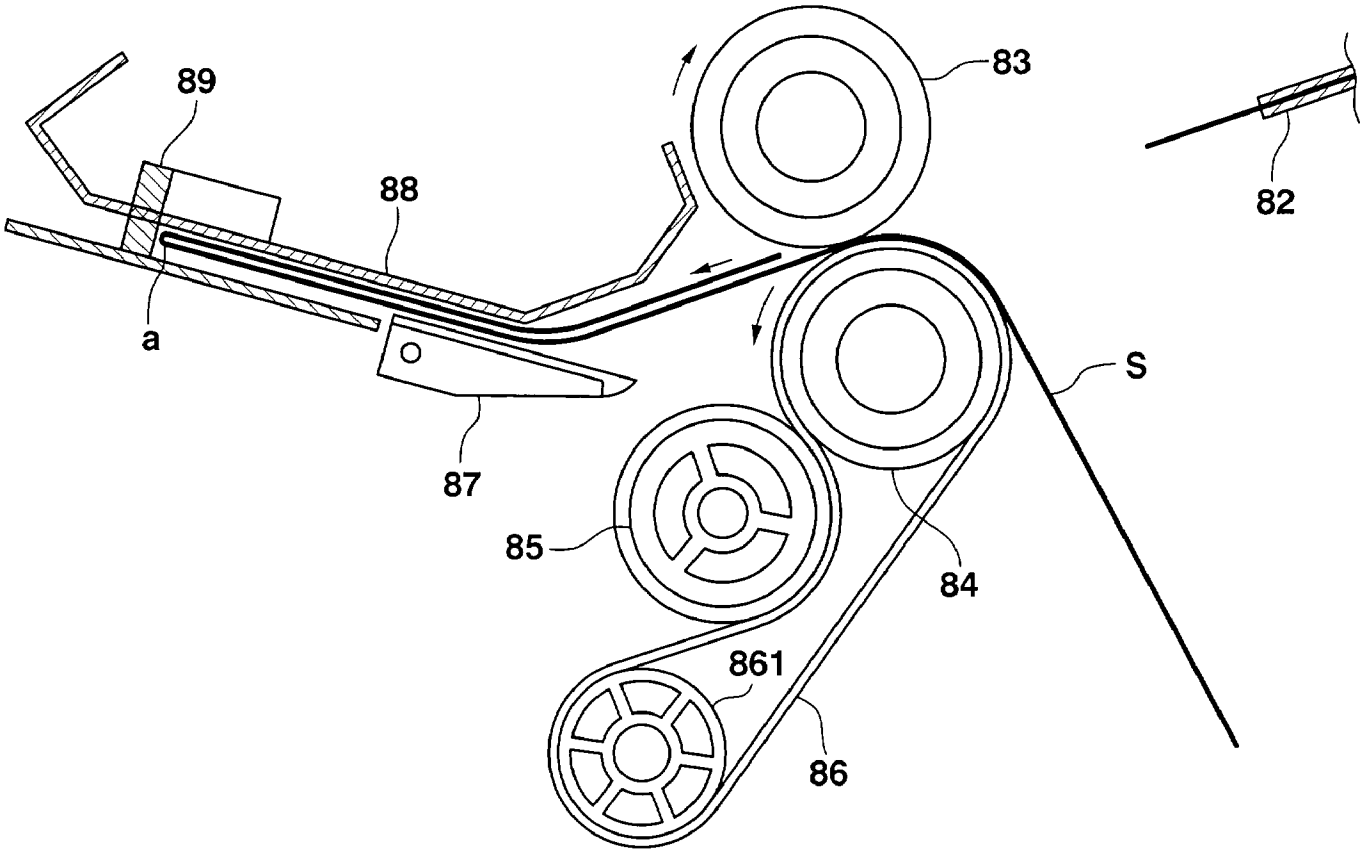

(c) As shown in FIG. 16, the sheet S on which the fold a is formed between the first folding rollers 83 and 84 is conveyed by the rotatably driven first folding rollers 83 and 84 in the direction indicated by a solid arrow and passes through the pair of opposing guide plates 88, so its fold a abuts against the sheet leading end stopping member 89.

Figure 17:
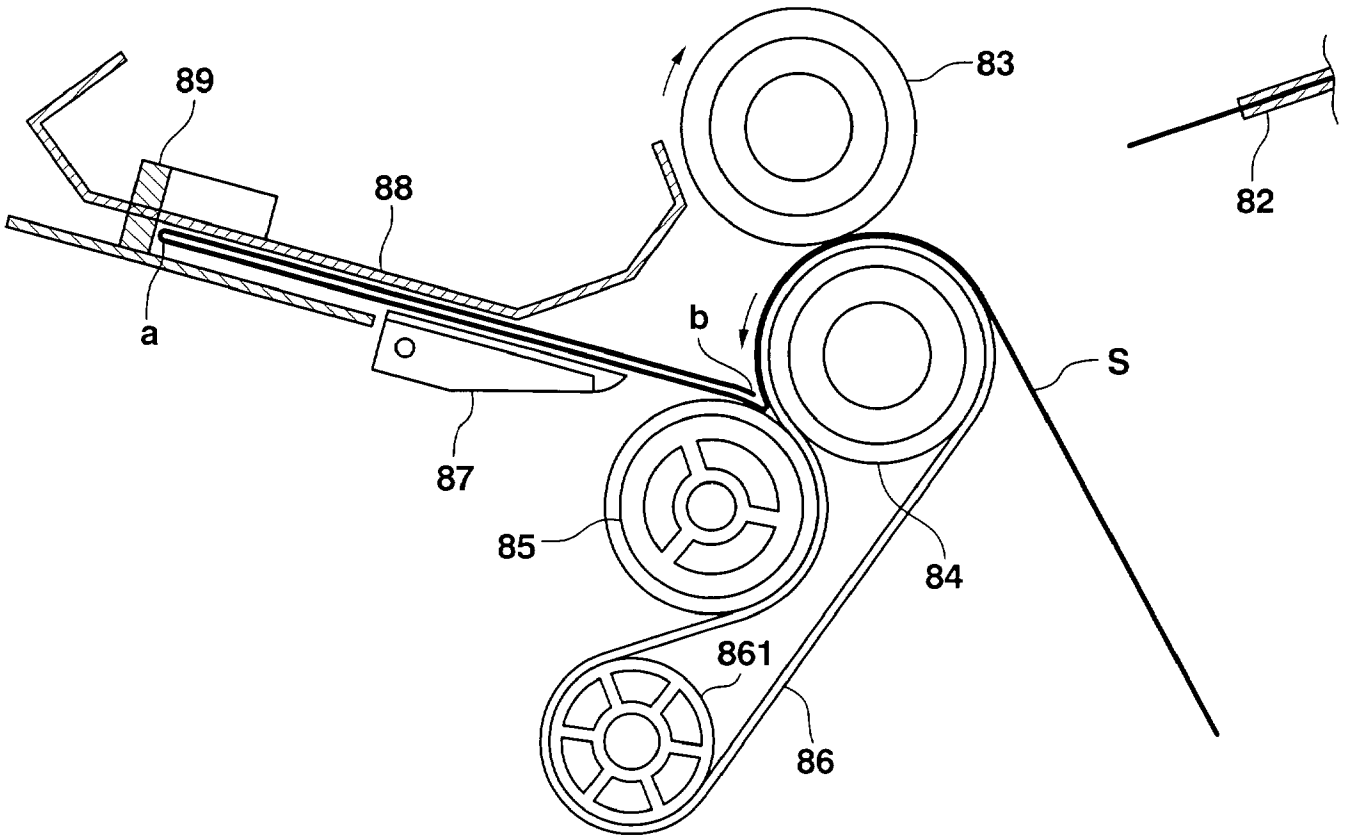

(d) As shown in FIG. 17, when the first folding rollers 83 and 84 are successively rotated, the fold a of the sheet S abuts against the sheet leading end stopping member 89, so the sheet S stops traveling. That trailing-end portion of the sheet S which is ⅓ the length is caught by the outer surface of the first folding roller 84 having a large frictional resistance and is conveyed to the clamping position where the first and second folding rollers 84 and 85 press against each other, so a fold b is formed on the sheet S.

Figure 18:
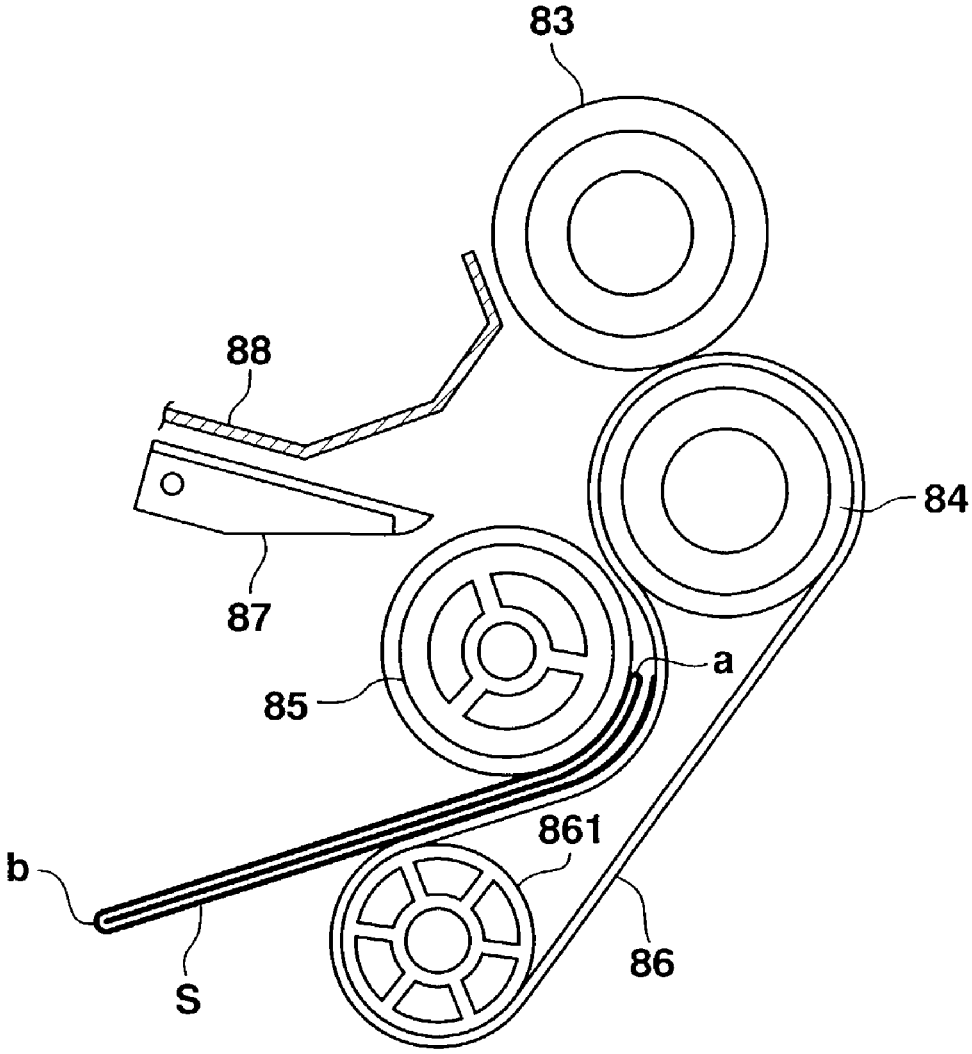

(e) As shown in FIG. 18, the folds a and b are formed on the sheet S at the clamping position of the first and second folding rollers 83 and 85, and the leading and trailing ends of the sheet S are folded back, so the sheet S is fold into three. The sheet S is then conveyed as it is clamped by the first and second folding rollers 83 and 85, tension roller 861, and convey belt 86, and is placed on the stationary delivery table 92 outside the apparatus.

Figure 19:
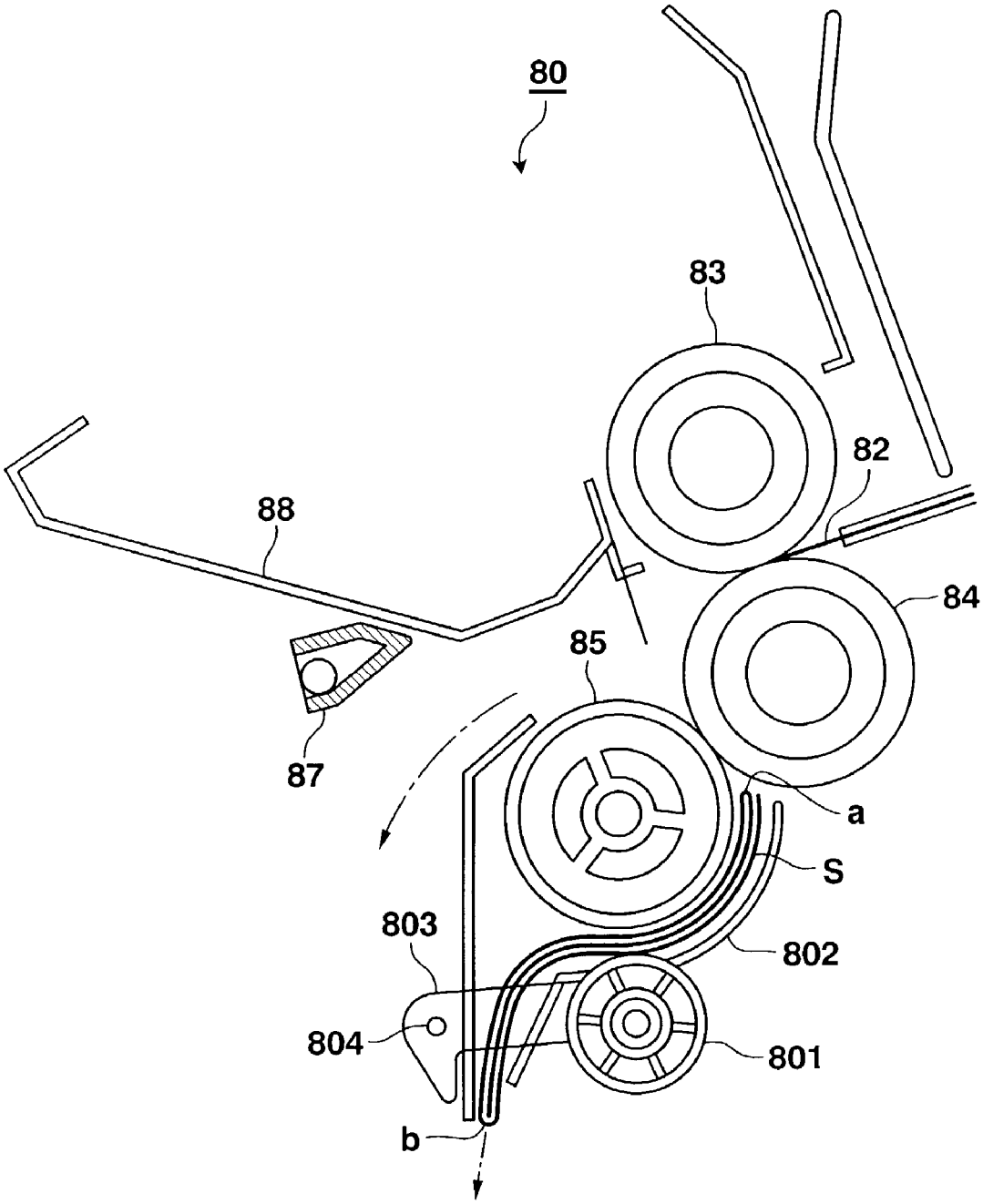
FIG. 19 is a sectional view showing a folding means according to another embodiment.

FIG. 19 is a sectional view showing a folding means 80 according to another embodiment. Regarding reference numerals used in FIG. 19, portions having the same function as the three-fold function shown in FIGS. 14 to 18 are denoted by the same reference numerals as in FIGS. 14 to 18. Portions that are different from the above embodiment will be described.

A folding means 80 can perform two modes, i.e. the two-fold process and the three-fold process. The folding means 80 has a first folding means for folding a bundle Sa of sheets in two and a second folding means for folding a bundle Sa of sheets in three.

The folding means is formed of first and second folding rollers 83 and 84 and a projecting plate 82. The second folding means is formed of a second folding roller 85, clamping roller 801, and guide plate 802. The second folding roller 85 is biased by a spring (not shown) and is pressed against by the first folding roller 83. The clamping roller 801 is rotatably supported at one end of a support member 803. The other end of the support member 803 is swingably supported by a pivot shaft 804. The support member 803 is biased by a spring (not shown) to press the clamping roller 801 against the second folding roller 85.

The folding means 80 shown in FIG. 19 is different from that of the embodiment shown in FIG. 18 in that it has the clamping roller 801 and guide plate 802 in place of the convey belt 86. The guide plate 802 guides the sheet S folded in three to the clamping position of the clamping roller 801 and second folding roller 85. The clamping roller 801 presses the sheet S folded in three at the clamping position with the second folding roller 85, to reliably fortify its folds a and b. The folding means 80 of this type is effective in that it does not form wrinkles on the sheet S.

(4-10) Control of Sheet Postprocessing:

When the sheet S delivered from the image forming apparatus A is sent into the first postprocessing apparatus B and its leading end is detected by the sensor PS1 in the vicinity of the inlet 10, rotation of the registration rollers 31A and 31B is stopped. The leading end of the sheet S entering the inlet 10 abuts against the clamping position of the stopped registration rollers 31A and 31B, and is adjusted.

When the registration rollers 31A and 31B resume rotatable driving, the sheet S is clamped and conveyed by the registration rollers 31A and 31B and intermediate convey rollers 33A and 33B, and the first fold c is formed on the sheet S by the first folding rollers 35A and 35B. After that, the second fold d is formed by the first and second folding rollers 35B and 35C.

In the sheet convey process before formation of the first fold c, the sheet S is clamped by the registration rollers 31A and 31B and intermediate convey rollers 33A and 33B. Hence, the sheet S is not skew but is held aligned. When the trailing end of the aligned sheet S passes through the sensor PS1, it is detected by the sensor PS1. Upon a lapse of a predetermined period of time since generation of the detection signal of the sensor PS1, sheet convey is temporarily stopped. The sheet S in the stop state is punched at a portion in the vicinity of its trailing end by the first punching means 20.

The sheet S which is punched by the first punching means 20 and folded into a Z shape by the first holding means 30 is delivered by the delivery means 40.

The sheet S, which is punched and/or folded into a Z shape and delivered from the first postprocessing apparatus B, is introduced to the second postprocessing apparatus C, passes through the first convey path F1, and is stored in the upper delivery table 93. Alternatively, the sheet S, which is punched and/or folded into a Z shape and introduced to the second postprocessing apparatus C, passes through the second convey path F2, and is stored in the vertically movable delivery table 92. Alternatively, the sheet S, which is punched and/or folded into a Z shape and introduced to the second postprocessing apparatus C, is shifted by the shift means 90 of the second convey path F2 in a direction perpendicular to the convey direction, is sorted or grouped, and is stored in the vertically movable delivery table 92.

A sheet S which is not to be folded into a Z shape is sent from the image forming apparatus A and loaded in the second postprocessing apparatus C through the first postprocessing apparatus B. At the second postprocessing apparatus C, the sheet S can be punched by the second punching means 60. The second punching means 60 can also selectively punch the insert paper J fed from the first feeder 51 and the cover paper K fed from the second feeder 52. The leading ends of the sheet S, insert paper J, and cover paper K introduced to the second punching means 60 abut against the clamping position of the registration rollers 65, and are aligned. The sheet S, insert paper J, and cover paper K, the distal ends of which are aligned, are punched by the second punching means 60.

The insert paper J and cover paper K corresponding to the sheet S punched and folded by the first postprocessing apparatus B are punched by the second punching means 60, and are delivered to be stacked together with the sheet S.

Figure 20:
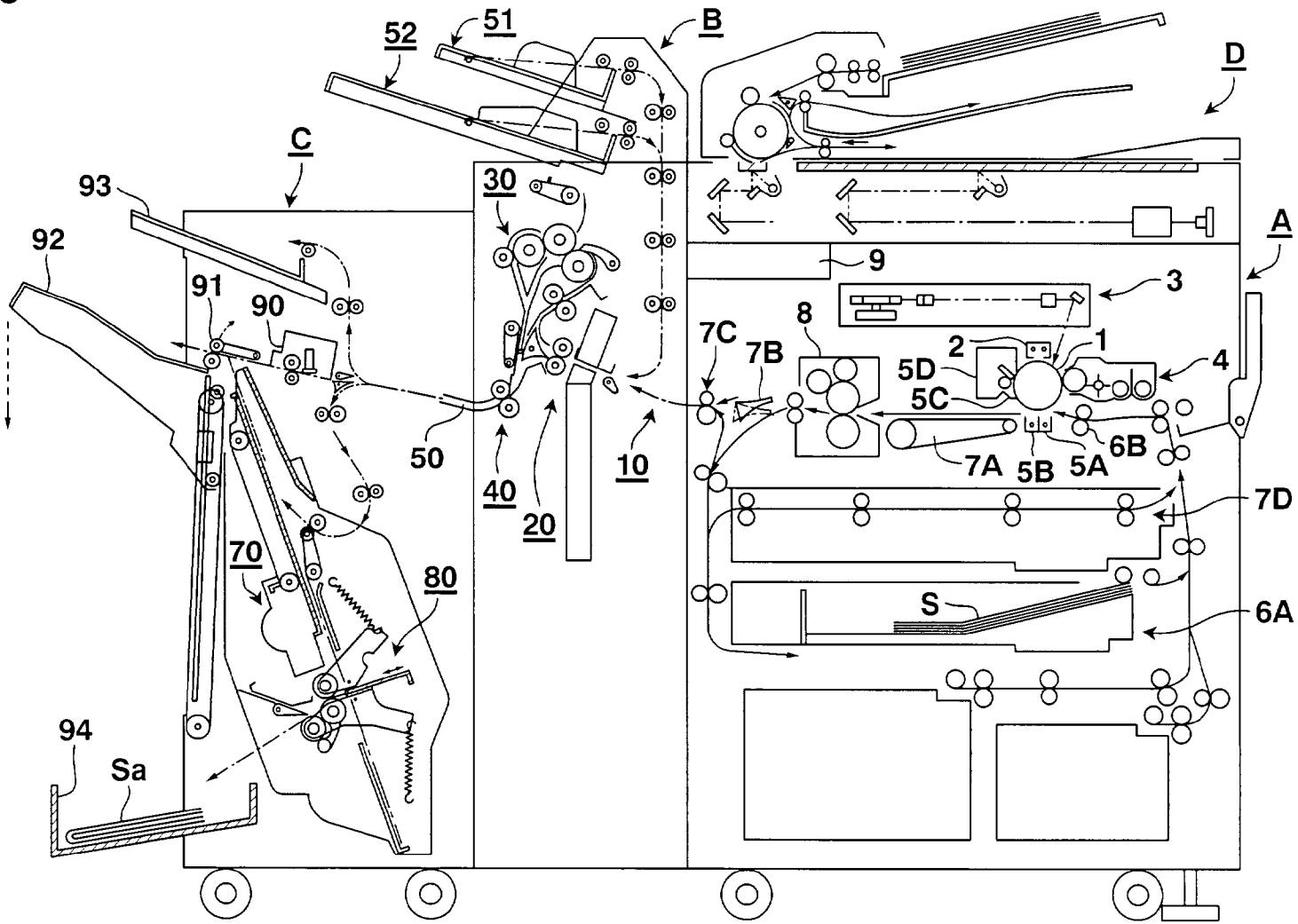
FIG. 20 shows the overall arrangement of an image forming system according to another embodiment, which is comprised of an image forming apparatus, first postprocessing apparatus, second postprocessing apparatus, and image reading apparatus.

FIG. 20 shows the overall arrangement of an image forming system according to another embodiment, which is comprised of an image forming apparatus A, first postprocessing apparatus B, second postprocessing apparatus C, and image reading apparatus D.

Regarding the reference numerals used in FIG. 20, portions having the same functions as those of FIG. 1 are denoted by the same reference numerals as in FIG. 1. Portions that are different from the above embodiment will be described.

The first postprocessing apparatus B is comprised of a first punching means 20 for punching a sheet S delivered from the image forming apparatus A at a predetermined position, a first holding means 30 for folding the punched sheet S, and first and second feeders 51 and 52 for storing sheets other than the sheet S, e.g., sheets other than insert paper J, cover paper K, or the sheet S stored in the image forming apparatus A, and feeding them to the first punching means 20.

The second postprocessing apparatus C is comprised of a shift means 90 for introducing and conveying the sheet S, insert paper J, cover paper K, or the like which are punched and folded by the first postprocessing apparatus B, a delivery means 91, a vertically movable delivery table 92 for storing the delivered sheets or the like, an upper delivery table 93, a stitching means 70 for stitching the sheet S, insert paper J, cover paper K, and the like delivered from the first postprocessing apparatus B, and a second folding means 80 for folding the sheet S, cover paper K, and insert paper J.

The sheet S, insert paper J, cover paper K, and the like sent to the first punching means 20 of the first postprocessing apparatus B are aligned at their distal ends before they are postprocessed by stitching or folding in the second postprocessing apparatus C, and are punched. The sheet S, the distal end of which is kept aligned, is punched by the first punching means 20 at its portion in the vicinity of the trailing end. Thus, the punching position precision is improved.

The first postprocessing apparatus B according to the present invention has been described concerning folding into a Z shape and folding in two. The present invention can also be applied to other sheet folding processes.

What is claimed is:

1. A postprocessing apparatus for processing an image recording sheet from an image forming apparatus comprising:

a punching unit for punching said image recording sheet; and a folding unit, arranged downstream of said punching unit in an image recording sheet convey direction, which performs a three-fold process of forming two folds on the image recording sheet after said image recording sheet is punched.

2. The apparatus according to claim 1, further comprising:

a feeding unit for storing and feeding a second sheet;

a second punching unit for punching said second sheet; and a control unit for selectively controlling the punching process and folding process in accordance with a selection signal that selects either one of the processes.

3. An image forming system comprising an image forming apparatus formed of image writing unit, image forming unit, and sheet convey unit, and the postprocessing apparatus according to claim 2.

4. An image forming system comprising an image forming apparatus formed of image writing unit, image forming unit, and sheet convey unit, and the postprocessing apparatus according to claim 1.

5. A postprocessing apparatus of claim 1, wherein the folding unit also performs a two-fold process for folding the image recording sheet.

6. A postprocessing apparatus of claim 5, wherein a fold in the two-fold process is performed at a center of the image recording sheet with respect to the image recording sheet convey direction.

7. A postprocessing apparatus of claim 1, wherein the three-fold process is performed in parallel to the image recording sheet convey direction.

8. A postprocessing apparatus for processing an image recording sheet from an image forming apparatus comprising:

(a) a first postprocessing apparatus comprising:

(i) a first punching unit for performing a punching process at a predetermined position of an image recording sheet delivered from an image forming apparatus, and (ii) a first folding unit for folding the punched sheet; and (b) a second postprocessing apparatus comprising:

(i) a delivery unit for introducing and delivering the sheet punched and folded by said first postprocessing apparatus, (ii) a feeding unit for storing and feeding a sheet other than the image recording sheet, and (iii) a second punching unit for performing a punching process at a predetermined position of the sheet fed from said feeding unit.

9. An apparatus according to claim 8, wherein said second postprocessing apparatus comprises second folding unit for folding the punched sheet.

10. An image forming system comprising an image forming apparatus formed of image writing unit, image forming unit, and sheet convey unit, and the postprocessing apparatus according to claim 9.

11. An image forming system comprising an image forming apparatus formed of image writing unit, image forming unit, and sheet convey unit, and the postprocessing apparatus according to claim 8.

12. A postprocessing apparatus for processing an image recording sheet from an image forming apparatus comprising:

a punching unit for forming, by a punching process, a hole for sheet filing at a predetermined position of one sheet conveyed by sheet convey unit;

a stitching unit, arranged downstream of said punching unit in a sheet convey direction, and capable of performing two stitching processes including an end stitching process of stitching a sheet at the vicinity of a side end thereof and a saddle stitching process of stitching a sheet at a center thereof in the convey direction;

a folding unit, arranged downstream of said stitching unit in the sheet convey direction, which performs a two-fold process of folding the sheet at a center thereof in the convey direction and a three-fold process of forming two folds on the sheet parallel to the convey direction; and a control unit for selectively controlling the punching process, the end stitching process, the saddle stitching process, the two-fold process, and the three-fold process in accordance with a selection signal that selects either one of the processes.

13. The apparatus according to claim 12, wherein the three-fold process includes an inward folding process and a Z-fold process.

14. An image forming system comprising an image forming apparatus main body formed of image writing unit, image forming unit, and sheet convey unit, and the postprocessing apparatus according to claim 12.

15. A postprocessing apparatus for processing an image recording sheet from an image forming apparatus comprising:

a stitching unit, which is capable of performing two stitching processes including an end stitching process of stitching a sheet conveyed by sheet convey unit at the vicinity of a side end thereof and a saddle stitching process of stitching a sheet at a center thereof in a convey direction; and a folding unit, arranged downstream of said stitching unit in the sheet convey direction, which performs a two-fold process of folding the sheet at the center thereof in the convey direction and a three-fold process of forming two folds on the sheet parallel to the convey direction, wherein a sheet bundle forming portion formed of said stitching unit and said folding unit is mounted on one flat planar frame, and said stitching unit, said folding unit, and the frame are formed into one unit, and the unit is mounted on a postprocessing apparatus main body to be withdrawable therefrom.

16. An apparatus according to claim 15, wherein the three-fold process includes an inward folding process and a Z-fold process.

17. An image forming system comprising an image forming apparatus main body formed of image writing unit, image forming unit, and sheet convey unit, and the postprocessing apparatus according to claim 15.

18. A postprocessing apparatus for processing an image recording sheet from an image forming apparatus comprising:

a punching unit for forming, by a punching process, a hole for sheet filing at a predetermined position of one sheet conveyed by sheet convey unit;

a two-stage feeding unit, arranged on an upper portion of a postprocessing apparatus main body, and capable of feeding two types of sheets to an upstream side of said punching unit;

a stitching unit, arranged downstream of said punching unit in a sheet convey direction, and capable of performing two stitching processes including an end stitching process of stitching a sheet at the vicinity of a side end thereof and a saddle stitching process of stitching a sheet at a center thereof in the convey direction;

a folding unit, arranged downstream of said stitching unit in the sheet convey direction, which performs a two-fold process of folding the sheet at the center thereof in the convey direction and a threefold process of forming two folds on the sheet parallel to the convey direction;

a shift unit, arranged downstream of said punching unit in the sheet convey direction, for shifting the sheet in a direction perpendicular to the convey direction;

a sheet branching unit, provided downstream of said punching unit in the sheet convey direction, and capable of conveying a sheet that has passed through said punching unit, by selecting either one of a sheet bundle forming portion formed of said stitching unit and said folding unit, and said shift unit; and a control unit for selectively controlling a sheet feeding process, the punching process, the stitching process, the folding processes, a shift process, and a branching process in accordance with a selection signal that selects either one of the processes.

19. An apparatus according to claim 18, wherein the three-fold process includes an inward folding process and a Z-fold process.

20. An image forming system comprising an image forming apparatus main body formed of image writing unit, image forming unit, and sheet convey unit, and the postprocessing apparatus according to claim 18.

* * * * *